US005712073A

United States Patent [19]

Katada et al.

[11] Patent Number: 5,712,073

[45] Date of Patent: Jan. 27, 1998

[54] TONER FOR DEVELOPING ELECTROSTATIC IMAGE, APPARATUS UNIT AND IMAGE FORMING METHOD

[75] Inventors: Masaichiro Katada, Numazu; Takashige Kasuya, Shizuoka-ken; Takakuni Kobori, Susono, all of Japan

[73] Assignee: Canon Kabushiki Kaisha, Tokyo, Japan

[21] Appl. No.: 777,241

[22] Filed: Dec. 31, 1996

[30] Foreign Application Priority Data

| | | | |
|---|---|---|---|
| Jan. 10, 1996 | [JP] | Japan | 8-018203 |
| Apr. 18, 1996 | [JP] | Japan | 8-119571 |

[51] Int. Cl.[6] ..... G03G 9/097; G03G 13/22

[52] U.S. Cl. ..... 430/110; 430/111; 430/125

[58] Field of Search ..... 430/110, 111

[56] References Cited

U.S. PATENT DOCUMENTS

| | | | |
|---|---|---|---|
| 2,297,691 | 10/1942 | Carlson | 430/31 |
| 3,666,363 | 5/1972 | Tanaka et al. | 430/55 |
| 4,071,361 | 1/1978 | Marushima | 430/55 |
| 4,626,487 | 12/1986 | Mitsuhashi et al. | 430/109 |
| 4,837,100 | 6/1989 | Murofushi et al. | 430/106.6 |
| 5,135,833 | 8/1992 | Matsumaya et al. | 430/110 |
| 5,424,810 | 6/1995 | Tomiyama et al. | 430/106.6 |
| 5,482,805 | 1/1996 | Grande et al. | 430/106 |

FOREIGN PATENT DOCUMENTS

| | | |
|---|---|---|
| 0335676 | 10/1989 | European Pat. Off. . |
| 0516434 | 12/1992 | European Pat. Off. . |
| 62-61073 | 3/1987 | Japan . |
| 1-191161 | 8/1989 | Japan . |
| 4-44051 | 2/1992 | Japan . |
| 1402010 | 8/1975 | United Kingdom . |

OTHER PUBLICATIONS

Patent Abstracts of Japan, Vol. 14, No. 238 (P-1050) [4181] May, 1990 for JP 2-059768.

*Primary Examiner*—Roland Martin

*Attorney, Agent, or Firm*—Fitzpatrick, Cella, Harper & Scinto

[57] ABSTRACT

A toner for developing electrostatic images is constituted as a powdery mixture of toner particles, inorganic fine powder, resin fine particles, and metal oxide particles. The toner has a weight-average particle size of 4–12 μm and contains at most 30% by number of particles having a particle size of at most 3.17 μm. The inorganic fine powder has an average primary particle size of 1–50 nm. The resin fine particles have an average particle size of 0.1–2 μm and a shape factor SF1 of at least 100 and below 150. The metal oxide particles have an average particle size of 0.3–3 μm and a shape factor SF1 of 150–250. The toner is effective for preventing toner sticking onto and ununiform abrasion of the electrostatic image-bearing member to allow the formation of high-quality images for a long life.

65 Claims, 3 Drawing Sheets

TONER FOR DEVELOPING ELECTROSTATIC IMAGE, APPARATUS UNIT AND IMAGE FORMING METHOD

FIELD OF THE INVENTION AND RELATED ART

The present invention relates to a toner for developing electrostatic images used in image forming methods, such as electrophotography and electrostatic printing, and also an apparatus unit containing the toner and an image forming method using the toner.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the electrostatic image is developed with a toner, and the resultant toner image is, after being transferred onto a transfer-receiving material such as paper, via or without via an intermediate transfer member, as desired, fixed by heating, pressing, or heating and pressing, or with solvent vapor to obtain a copy or a print. The residual toner on the photosensitive member without being transferred is cleaned by various methods, and then the above steps are repeated.

In such electrophotographic process, it has been a general practice to remove residual toner on an electrostatic image-bearing member by causing a cleaning member, such as a cleaning blade, a fur brush or a magnetic brush, to contact the electrostatic image-bearing member. In this case, the cleaning member is abutted against the electrostatic image-bearing member at an appropriate pressure, so that the electrostatic image-bearing member is liable to be damaged or toner sticking onto the electrostatic image-bearing member is liable to be caused during a long period of repetitive use.

On the other hand, as a charging method, there have been recently made many proposals regarding a contact-charging method wherein a charging member is abutted against the electrostatic image-bearing member and is supplied with a superposition of a DC voltage and an AC voltage to charge the image-bearing member. The contact-charging method is accompanied with advantages such that a lower voltage can be used compared with a conventional corona-charging method and the occurrence of ozone is reduced. In the contact charging method, as shown in FIG. 3, for example, a charging roller 2 (as a charging member) is caused to contact an electrostatic image-bearing member (photosensitive drum) 1 so as to be rotated following the rotation of the photosensitive drum 1 and is supplied with a superposed voltage (Vac+Vdc) of an AC voltage Vac and a DC voltage Vdc to uniformly charge the photosensitive drum 1.

As is understood from the above description, the charging roller 2 is required to exhibit an electroconductivity, and an example thereof in use has been formed as an electroconductive elastic member prepared by dispersing carbon within an elastic rubber, such as EPDM or NBR. As a result, the charging member 2 is inevitably caused to have an ASKER-C rubber hardness of 70 deg. or higher. In the case of effecting contact-charging by using a charging roller 2 as described above, an electroconductive member is caused to vibrate due to an AC component Vac of the voltage applied to a core metal, a noise occurs at a nip position (abutting position) between the charging roller 2 and the photosensitive drum 1. The noise is liable to be larger if the charging roller has a larger hardness.

The occurrence of the noise can be obviated if the AC component Vac of the applied voltage is removed but, in that case, it becomes difficult to uniformly surface-charge the photosensitive drum 1, thus being liable to result in spot-shaped charging irregularity.

The assignee of this application has proposed a contact-charging method using a charging member having an ASKER-C hardness of at most 60 deg. so as to suppress the noise level (JP-A 1-191161).

In recent years, an increasing demand has occurred for a lower energy consumption and a higher process speed of copying machines or printers utilizing electrophotography. As a result, it is preferred to design a toner therefor so as to be softened at a lower energy consumption. When such a toner is used in combination with a charging member having a lower hardness as described above, the toner is liable to melt-stick onto the electrostatic image-bearing member surface, thus being liable to shorten the life of the electrostatic image-bearing member. The tendency is promoted in the case where the charging member is in the form of a roller. This is presumably because a lowering in hardness of the charging member promotes the deformation of the charging member when a driving force for the electrostatic image-bearing member is transmitted via a contacting boundary to the charging member, so that the driving force is dispersed to cause a slippage at the boundary between the charging member and the electrostatic image-bearing member.

In order to obviate the sticking of a toner onto an electrostatic image-bearing member, U.K. Patent No. 1,402,010, for example, has proposed to add both a friction-reducing substance and an abrasive substance. According to this method, however, it becomes difficult to remove low-resistivity substance, such as paper dust and ozone adduct, during repetitive use, and particularly an image flow defect is liable to occur due to disturbance of an electrostatic image caused by such low-resistivity substance on the electrostatic image-bearing member.

In order to solve such problems, JP-A 62-61073 and U.S. Pat. No. 4,626,487 have proposed a toner containing a metal oxide and silica fine powder. By the toner, however, it has become difficult to prevent the toner melt-sticking onto the electrostatic image-bearing member and ununiform abrasion of the electrostatic image-bearing member due to an increase in toner load in the charging step and the cleaning step so as to satisfy a requirement of higher-speed recording apparatus in recent years.

Further, JP-A 4-44051 has proposed a toner containing hydrophobic silica particles, resin fine particles and a metal oxide. However, the respective particles in the toner have not been specified with respect to environmental characteristics, the toner is liable to be accompanied with difficulties, such as a charge decrease in a high temperature-high humidity environment and a charge-up (an excessive charge) in a low temperature—low humidity environment. Further, it is also necessary to further suppress the occurrence of damage on and the toner sticking onto the electrostatic image-bearing member.

SUMMARY OF THE INVENTION

An object of the present invention is to provide a toner for developing electrostatic images, and an apparatus unit and an image forming method using such a toner.

Another object of the present invention is to provide a toner for developing electrostatic images capable of preventing toner ticking onto and ununiform abrasion of an electrostatic image-bearing member, thus providing high-quality images for a long period even when applied to a high-speed apparatus.

Another object of the present invention is to provide an apparatus unit containing such a toner.

A further object of the present invention is to provide an image forming method using a charging member supplied with a voltage having an AC component for contact-charging an electrostatic image-bearing member with little occurrence of ozone and suppressed noise occurrence, whereby it is possible to prevent the toner sticking onto and ununiform abrasion of the electrostatic image-bearing member, thus realizing a long life of the electrostatic image-bearing member.

According to the present invention, there is provided a toner for developing electrostatic images, comprising: toner particles, inorganic fine powder, resin fine particles, and metal oxide particles; wherein the toner has a weight-average particle size of 4–12 μm and contains at most 30% by number of particles having a particle size of at most 3.17 μm;

the inorganic fine powder has an average primary particle size of 1–50 μm;

the resin fine particles have an average particle size of 0.1–2 μm and a shape factor SF1 of at least 100 and below 150, and the metal oxide particles have an average particle size of 0.3–3 μm and a shape factor SF1 of 150–250.

According to another aspect of the present invention, there is provided an apparatus unit, comprising: an electrostatic image-bearing member, and developing means for developing an electrostatic image formed on the electrostatic image-bearing member with the above-mentioned toner contained therein; the electrostatic image-bearing member and the developing means being integrally assembled to form a unit, which is detachably mountable to a main assembly of the image forming apparatus.

According to a further aspect of the present invention, there is provided an image forming method, comprising the steps of:

charging a surface of an electrostatic image-bearing member, forming an electrostatic image on the electrostatic image-bearing member, developing the electrostatic image with the above-mentioned toner for developing electrostatic images to form a toner image, transferring the toner image formed on the electrostatic image-bearing member to a transfer-receiving material, cleaning the surface of the electrostatic image-bearing member after the transfer by abutting a cleaning member thereto, and repeating the above-mentioned steps by using the cleaned electrostatic image-bearing member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
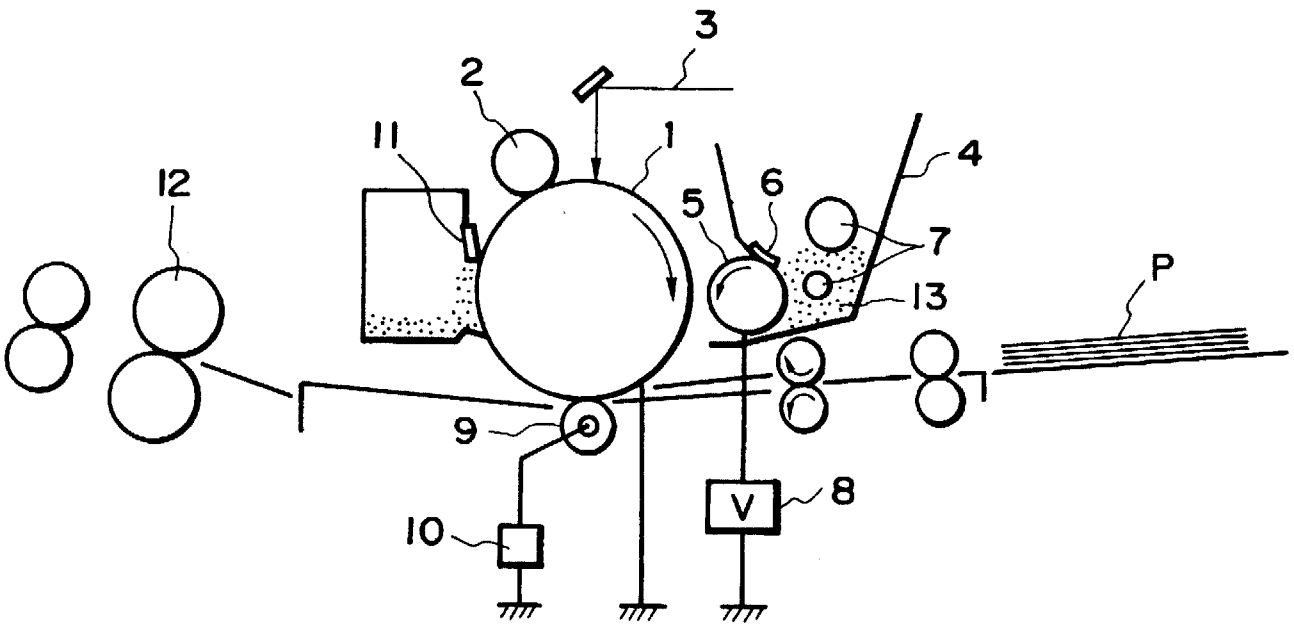
FIG. 1 is an illustration of an example of image forming apparatus suitable for use in an image forming method according to the invention.

Because of the above-mentioned features, the toner according to the present invention can exhibit excellent performances in response to requirements for high-speed image formation and continuous image formation characteristic in these days.

More specifically, principally the inorganic fine powder and metal oxide particles, in isolated form, scrape off paper dust and toner attached onto an electrostatic image-bearing member surface. Of these, the inorganic fine powder having a fine particle size as specified above and therefore a large specific surface area finely scrapes the image-bearing member and is also effective for reducing friction resistance between the image bearing member-surface and the cleaning member or the charging member.

On the other hand, the metal oxide particles having a particle size and a shape as defined above is effective for removing the attached substance which cannot be easily removed by the inorganic fine power because of strong sticking or sticking over a wide area.

Further, the resin fine particles having a particle size and a shape as defined above is effective for alleviating locally excessive abrasion even when the metal oxide particles are present locally in concentrated state and adsorbing excessive inorganic fine powder in isolated form to facilitate the cleaning thereof. A very slight portion of the resin fine particles may slip by or pass through the cleaning member to capture a very small amount of toner, etc., also having passed by the cleaning member, thereby obviating staining of the charging member liable to result in charging failure, and damage on or sticking onto the image bearing member.

The above-mentioned functions are effectively fulfilled by using a toner having a specified particle size distribution and external additives having highly specified particle sizes and shapes. The chargeability of the toner is also stabilized thereby.

Further, at the time of transfer of a toner image from the electrostatic image-bearing member to a transfer-receiving material in a transfer step, the metal oxide particles charged to a polarity opposite to that of the toner may move from the toner on the transfer-receiving material to the image bearing member surface or the toner thereon. Alternatively, in the case of transfer of a portion of toner to which a larger amount of the metal oxide is attached, the metal oxide particles may remain on the image bearing member. For either of the above-mentioned mechanisms, a large proportion of metal oxide particles is allowed to remain on the image bearing member after the transfer step to effectively remove the attachment onto the image bearing member surface.

In the charging step, for a very small amount of toner passing by the cleaning member, the use of a soft charging member having an ASKER-C hardness of at most 60 deg. is preferred because the surface portion of the charging member flexibly deforms at the abutting portion against the image bearing member to ensure a good contact with the image bearing member even if such a staining substance is slightly present on the charge member surface, thus not readily causing transfer failure.

The toner for developing electrostatic images according to the present invention has a weight-average particle size (diameter, D4) of 4–12 μm, and contains at most 30% by number of particles having a particle size of at most 3.17 μm.

In case where the toner has a weight-average particle size of below 4 μm, the toner is caused to have a lower fluidity and an increased attachment force, thus resulting in lower developing, transfer and cleaning performances. On the other hand, in excess of 12 μm, the image-reproducing performance becomes problematic. Further, if the particles of at most 3.17 μm exceed 30% by number, the cleaning failure or occurrence of fog is liable.

The weight-average particle size of a toner may be measured by using a Coulter counter Model TA-II or Coulter Multisizer (available from Coulter Electronics Inc.) together with a 1%-NaCl aqueous solution as an electrolytic solution prepared by using a reagent-grade sodium chloride. Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40 μm by using the above-mentioned apparatus with a 100 μm-aperture to obtain a volume-basis distribution and a number-basis distribution. The weight-basis average particle size $D_4$ may be obtained from the volume-basis distribution while a central value in each channel is taken as a representative value for each channel.

The effects of the present invention may be enhanced by adding eternal additives having specified particle sizes relative to the above-mentioned particle size of the toner. More specifically, the inorganic fine powder has an average primary particle size of 1–50 nm, the resin fine particles have an average particle size of 0.1–2 μm and the metal oxide particles have an average particle size of 0.3–3 μm.

In case where the inorganic fine powder has an average primary particle size of below 1 nm, the resultant toner may be provided with an improved flowability but is liable to have an inferior environmental characteristic. On the other hand, above 50 nm is liable to result in insufficient toner flowability-improving effect leading to fog and inferior developing performance.

In case where the resin fine particles have an average particle size below 0.1 μm, it is impossible to sufficiently alleviate the abrasion of the electrostatic image-bearing member with the metal oxide particles. Further, a large proportion thereof is liable to pass by the cleaning member, thus soiling the charging member. Above 2 μm fails to effect adsorptive capture of isolated inorganic fine powder.

In case where the metal oxide particles have an average particle size below 0.3 μm, it is liable to fail in removal of attached substance onto the image bearing member or pass by the cleaning member to cause image defects. Above 3 μm is liable to cause remarkable abrasion of the image bearing member surface or the developer-carrying member (developing sleeve) surface.

Another characteristic feature of the present invention is that the resin fine particles and metal oxide particles have shape factors as described below.

The resin fine particles may have a shape factor SF1 of at least 100 and below 150, preferably at least 115 and below 145, and a shape factor SF2 of at least 110 and below 200, preferably at least 120 and below 175.

The metal oxide particles may have a shape factor SF1 of 150–250, preferably 160–230, and a shape factor SF2 of 160–300, preferably 175–270.

We have discovered that it is important for the respective external additives have a specific sphericity (SF1) and a specific unevenness (SF2) in addition to the above-mentioned particle sizes. The sphericity and unevenness are remarkably related with the cleaning performances and performances for removing attached substances with the use of a cleaning member.

The resin fine particles may preferably be generally spherical and also have some degree of unevenness, so that they are not readily taken into the cleaning member but remain at the position of contact between the cleaning member and the image-bearing member, thereby increasing the cleanability of the other components in the toner. Further, as they are generally spherical, they can pass by the cleaning member to some extent to capture the other components, such as toner particles, on the charging member, thereby preventing the occurrence of damage on the image bearing member.

The metal oxide particles may preferably have somewhat large values of sphericity (SF1) and unevenness (SF2), thus showing an indefinite shape. Spherical particles exhibit an inferior performance of removing the attached substance and provide an increased proportion of those passing by the cleaner member, thus being liable to cause lack of image portions and biased abrasion of the image bearing member.

The shape factors SF-1 and SF-2 referred to herein are based on values measured in the following manner. Sample particles are observed through a field-emission scanning electron microscope ("FE-SEM S-800", available from Hitachi Seisakusho K.K.) at a magnification of 30000–60000, and 10 particle images are sampled at random within an average particle size range for each external additive. The image data are inputted into an image analyzer ("Luzex 3", available from Nireco K.K.) to obtain averages of shape factors SF1 and SF2 based on the following equations:

$$SF1=[(MXLNG)^2/\text{AREA}]\times(\pi/4)\times 100,$$

$$SF2=[(PERIME)^2/\text{AREA}]\times(1/4\pi)\times 100,]$$

wherein MXLNG denotes the maximum of a sample particle, PERIME denotes the perimeter of a sample particle, and AREA denotes the projection area of the sample particle.

The inorganic fine powder may preferably have a specific surface area ($S_{BET}$) of 70–300 $m^2/g$, more preferably 70–150 $m^2/g$. The resin fine particles may preferably have a specific surface area of 5.0–20.0 $m^2/g$, more preferably 8.0–15.0 $m^2/g$. The metal oxide particles may preferably have a specific surface area of 0.5–10 $m^2/g$.

If $S_{BET}$ of the inorganic fine powder is below 70 $m^2/g$, the powder is liable to be present in an isolated state at a high probability, thus being liable to cause localization of the inorganic fine powder and black spots due to agglomerates thereof. $S_{BET}$ above 300 $m^2/g$ is liable to result in a toner showing a high moisture absorptivity leading to a lower environmental stability. If $S_{BET}$ of the resin fine particles is below 5.0 $m^2/g$, the particles can only show a low capacity of adsorbing isolated inorganic fine powder. Above 20.0 $m^2/g$ makes it difficult to sufficiently alleviate the abrasion due to the metal oxide particles of the electrostatic image-bearing member. If $S_{BET}$ of the metal oxide particles is below 0.5 $m^2/g$, the abrasion of the image bearing member surface and the developer-carrying member is liable to be noticeable. Above 10.0 $m^2/g$ can result in failure of removal of attached substance on the image bearing member or passing-by of the metal oxide particles to cause image defects.

The resin fine particles may preferably have a volume resistivity ($R_V$) of $10^7$–$10^{14}$ ohm.cm, more preferably $10^8$–$10^{14}$ ohm.cm. If the resin fine particles have a volume resistivity below $10^7$ ohm.cm, the resultant toner is liable to have an insufficient chargeability, and the resin fine particles are liable to leak charges when attached in an isolated form onto the image-bearing member. Above $10^{14}$ ohm.cm is liable to cause the charge-up of the toner leading to a lower image density.

The inorganic fine powder may preferably be added in an amount of 0.3–3.0 wt. % of the toner. The resin fine particles may preferably be added in an amount of 0.005–0.5 wt. % of the toner. The metal oxide particles may preferably be added in a proportion of 0.05–5.0 wt. %, more preferably 0.5–2.0 wt. %, of the toner.

If the amount of the inorganic fine powder is below 0.3 wt. %, the resultant toner is caused to have an increased agglomeratability, and above 3.0 wt. % is liable to cause a charge-up of the toner. If the amount of the resin fine particles is below 0.005 wt. %, it becomes difficult to appropriately moderate the abrasion force of the metal oxide particles, and above 0.5 wt. % is liable to result in a cleaning failure and thus soiling of the charging roller. If the amount of the metal oxide particles is below 0.05 wt. %, the abrasion force onto the image-bearing member is liable to be weak, and above 5.0 wt. % is liable to cause excessive and ununiform abrasion of the image-bearing member.

The inorganic fine powder used in the present invention may most preferably comprise silica fine powder. The silica fine powder can be either the so-called "dry process silica" (or "fumed silica") which can be obtained by oxidation of gaseous silicon halide, or the so-called "wet process silica" which can be produced from water glass, etc. Among these, the dry process silica is preferred to the wet process silica because the amount of the silanol group present on the surfaces or in interior of the particles is small and it is free from production residue, such as $Na_2O$, $SO_3^{2-}$, etc. During the dry process silica production step, it is also possible to use another metal halide, such as aluminum chloride or titanium chloride, together with the silicon halide to obtain a composite fine powder of silica with another metal oxide. Silica fine powder herein may also include such composite silica fine powder.

The inorganic fine powder used in the present invention may preferably be a hydrophobic one in view of environmental stability.

For providing hydrophobic inorganic fine powder, it is possible to use known agent and method for hydrophobization (hydrophobicity-imparting). The hydrophobicity-imparting agent may preferably be a silicone compound having an organosiloxane unit, such as silicone oil or silicone varnish, and silicone oil is particularly preferred in view of the flowability and chargeability of the resultant toner.

Examples of the silicone oil for treating the inorganic fine powder used in the present invention may include those represented by the following general formula:

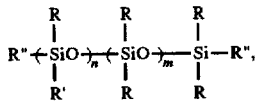

wherein R is alkyl group having 1–3 carbon atoms; R' is a silicone oil-modifying group, such as an alkyl group, a halogen-modified alkyl group, a phenyl group or a modified phenyl group; R" is an alkyl or alkoxy group having 1–3 carbon toms; and m and n are respectively an integer. Examples thereof may include: dimethylsilicone oil, alkyl-modified silicone oil, α-methylstyrene-modified silicone oil, chlorophenylsilicone oil and fluorinated silicone oil. These are not exhaustive examples of silicone oil suitably used in the present invention.

The silicone oil may preferably have a viscosity at 25° C. of 50–1,000 centi-stokes. Below 50 centi-stokes, the silicone oil is liable to cause partial evaporation under heating to result in an inferior chargeability. Above 1,000 centi-stokes provides a difficulty in processing. The silicone oil treatment may be performed in a known manner. For example, the inorganic fine particles may be blended with silicone oil in a blender, such as a Henschel mixer; silicone oil may be sprayed into the inorganic fine powder by using a sprayer; or a silicone oil solution in a solvent may be blended with the inorganic fine powder. The treatment method need not be restricted to the above.

The silicone varnish used for treating the inorganic fine powder may be known ones. Commercially available examples thereof may include "KR-251", "KP-112", etc., available from Shin-Etsu Silicone K.K. The treatment with silicone varnish may be performed in a known manner similarly as the silicone oil treatment.

A portion of such a silicon compound having an organosiloxane unit surface-treating the inorganic fine powder may be transferred onto the electrostatic image-bearing member to exhibit an effect of cleaning a powder substance, such as isolated polyolefin.

The hydrophobicity of the inorganic fine powder referred to herein is based on values measured in the following manner.

Into a tightly stoppable 200 ml-separating funnel, 100 ml of deionized water and 0.1 g of a sample powder are placed. After stopping, the funnel is set in a shaker ("Turbla Shaker Mixer T2C") and shaked at 90 rpm for 10 min. After the shaking, the funnel is left standing still for 10 min. After se. paration into an upper inorganic powder-containing layer and a lower aqueous layer, 20–30 ml of the lower aqueous layer is taken into a 10 mm-cell, and a transmittance thereof is measured at a wavelength of 500 nm with reference to blank de-ionized water containing no inorganic fine powder. The measured transmittance is taken as a hydrophobicity of the inorganic fine powder sample.

The hydrophobic inorganic fine powder preferably used in the present invention may exhibit a hydrophobicity of at least 60%, preferably at least 90%. At a hydrophobicity of below 60%, it becomes difficult to obtain high-quality images in a high-humidity environment due to moisture absorption by the inorganic fine powder.

Figure 4:
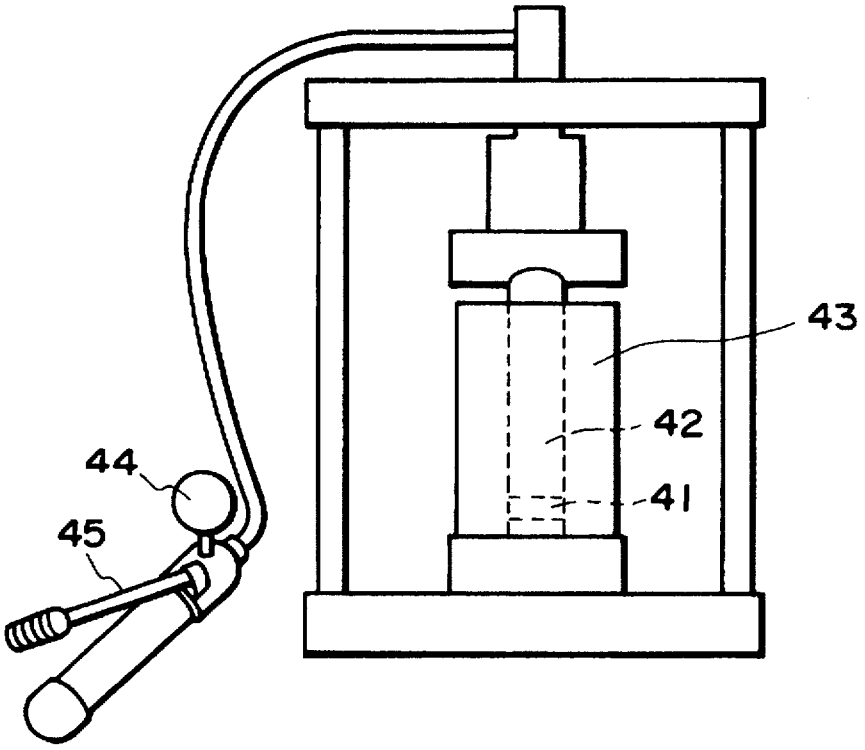
FIG. 4 is an illustration of a tablet-forming machine for measuring a volume resistivity of resin fine particles.

The volume resistivity of resin fine particles used in the present invention may be measured, e.g., in the following manner. Sample resin particles 41 may be molded into a pellet by using a pelletizer as shown in FIG. 4. Ca. 0.3 g of a sample 41 is placed in a pelletizing chamber 43. Then, a pressing rod 42 is inserted into the pelletizing chamber 43, and a pressure of 250 $kg/cm^2$ (at a pressure gauge 44) is applied for 5 min. from an oil-pressure pump to form a pellet having a diameter of ca. 13 mm and a thickness of ca. 2–3 mm.

The thus-obtained pellet, after application of an electroconductive agent onto upper and lower surfaces, may be subjected to measurement of a resistance value (R) under application of a voltage of 1000 volts in an environment of temperature of 23.5° C. and a humidity of 65% RH by using a resistance meter (e.g., 16008A RESISTIVITY CELL" or "4329A HIGH RESISTANCE METER", respectively available from Hewlett-Packard Co.). From the measured resistance value R (ohm), a volume resistivity ρ or $R_V$ may be calculated according to the following formula:

$$\rho(\text{ohm}.cm)=R(\text{ohm})\times S(cm^2)/l(cm),$$

wherein S is a sample sectional area and l is a sample thickness or height.

The resin fine particles may be produced by emulsion polymerization or spray drying under an appropriately adjusted condition. It is preferred to use resin fine particles having a glass transition point of at least 80° C. and comprising a homopolymer or a copolymer of monomers used for providing a toner binder resin, such a styrene, acrylic acid, acrylic acid, methyl methacrylate, butyl acrylate, and 2-ethyhexyl acrylate.

It is also possible to use a polymer crosslinked with a crosslinking agent, such as divinylbenzene. For the adjustment of volume resistivity and triboelectric chargeability, it is possible to surface-treat the resin fine particles with, e.g., a metal, a metal oxide, a pigment or dye, or a surfactant.

It is particularly preferred that the resin fine particles comprise a styrene copolymer in a block or random copolymer form containing at least 51 wt. % of polymerized units of styrene or a substituted styrene. Such styrene-based resin fine particles have a position in a triboelectric chargeability series closer to that of styrene-acrylic resin or polyester resin ordinarily used as toner binder resin, thus being little liable to cause mutual charging with toner particles or deteriorate the flowability. For this reason, it is also preferred to use a styrene-based resin as a toner binder resin.

If the styrene monomer polymerized unit content in the resin fine particles is less than 51 wt. %, the resultant toner is liable to exhibit strong agglomeratability and worse flowability, leading to image white dropout and image density irregularity.

The metal oxide particles may comprise, for example: an oxide of magnesium, zinc, aluminum, cobalt, zirconium, manganese, cerium or strontium; or a composite metal oxide, such as calcium titanate, magnesium titanate, strontium titanate, or barium titanate. Among these, in view of abrasion performance acting onto the electrostatic image-bearing member and toner chargeability, it is most preferred to use strontium titanate or cerium oxide.

The specific surface areas ($S_{BET}$) of inorganic fine powder, resin fine particles and metal oxide particles referred to herein are based on values measured by using a full-automatic adsorption measurement apparatus ("AUTOSORB 1", available from Yuasa Ionix K.K.) according to the BET mulit-point method using nitrogen as an adsorbate gas for a sample subjected to evacuation at 50° C. for 10 hours as a pretreatment.

The triboelectric chargeability including polarity of the toner, the hydrophobic silica, resin fine particles and metal oxide particles may for example be evaluated by using a two-component triboelectric charging system by using an iron powder carrier.

It is further preferred that the toner particles comprise polymer components characterized by:

(a) containing substantially no THF (tetrahydrofuran)-insoluble content, (b) containing a THF-soluble content giving a GPC (gel-permeation chromatography) chromatogram showing a main peak in a molecular weight region of $3\times10^3$–$3\times10^4$, and a sub-peak or shoulder in a molecular weight region of $1\times10^5$–$3\times10^6$, and (c) having an acid value of at least 1 mgKOH/g.

It is further preferred that the polymer components include a low-molecular weight polymer component having molecular weights of below $5\times10^4$ on the GPC chromatogram and an acid value $A_{VL}$, and a high-molecular weight polymer component having molecular weights of at least $5\times10^4$ and an acid value $A_{VH}$ satisfying $A_{VL}>A_{VH}$.

It is further preferred that the acid value $A_{VL}$ of the low-molecular weight polymer component is 21–35 mgKOH/g, and the acid value $A_{VH}$ of the high-molecular weight polymer component is 0.5–11 mgKOH/g, giving a difference satisfying $10<(A_{VL}-A_{VH})\leqq27$.

It is further preferred that the polymer components provide an acid value/total acid value ratio of at most 0.7.

It is further preferred that the THF-soluble content of the polymer components provides the GPC chromatogram showing a minimum value in a molecular weight region of at least $3\times10^4$ and below $1\times10^5$.

The above-mentioned preferred conditions for the toner polymer components will now be described in further detail.

It is preferred that the toner polymer components are substantially free from THF-insoluble content. More specifically, the polymer components do not contain more than 5 wt. %, preferably more than 3 wt. %, of a THF-insoluble content.

The "THF-insoluble content" referred to herein means a polymer component (substantially, a crosslinked polymer) which is insoluble in a solvent THF (tetrahydrofuran) within a resin composition constituting a toner, and thus may be used as a parameter indicating the degree of crosslinking of a resin composition containing a crosslinked component. The THF-insoluble content may be defined as a value measured in the following manner.

Ca. 0.5–1.0 g of a toner sample is weighed (at $W_1$ g) and placed in a cylindrical filter paper (e.g., "No. 86R" available from Toyo Roshi K.K.) and then subjected to extraction with 100–200 ml of solvent THF in a Soxhlet's extractor. The extraction is performed for 6 hours. The soluble content extracted with the solvent is dried first by evaporation of the solvent and then by vacuum drying at 100° C. for several hours, and weighed (at $W_2$ g). The components other than the resin component, such as a magnetic material and pigment, are weighed or determined (at $W_3$ g). The THF-insoluble content (wt. %) is calculated as $[(W_1-(W_3+W_2))/(W_1-W_3)]\times100$.

A THF-insoluble content exceeding 5 wt. % results in an inferior low-temperature fixability.

The THF-soluble content of the polymer components in the toner composition according to the present invention has a main peak in a molecular weight region of $3\times10^3$–$3\times10^4$, preferably $5\times10^3$–$2\times10^4$, and a sub-peak or shoulder in a molecular weight region of $1\times10^5$–$3\times10^6$, preferably $5\times10^5 1\times10^6$, respectively on a GPC (gel permeation chromatography) chromatogram thereof.

In the toner of the present invention, it is preferred that the THF-soluble polymer component includes a polymer component having a molecular weight of at least $10^6$ showing an areal proportion of at least 3%, more preferably 3–10%, on the above-mentioned GPC chromatogram. By including the THF-soluble component having a molecular weight of at least $10^6$ in a proportion of at least 3%, it becomes possible to improve the anti-offset characteristic without impairing the low-temperature fixability and also enhance the storage stability under standing at a high temperature.

The molecular weight distribution of polymer components in toners described herein are based on values measured by GPC (gel permeation chromatography) under the following conditions.

[GPC measurement for polymer components in toner]

Apparatus: GPC-150C (available from Waters Co.)

Columns: 7 columns of KF801–KF807 (all available from Showdex K.K.)

Temperature: 40° C.

Solvent: THF (tetrahydrofuran)

Flow rate: 1.0 ml/min.

Sample concentration: 0.05–0.6 wt. %

Sample volume: 0.1 ml

The toner polymer components may preferably have an acid value of at least 1 mgKOH/g, more preferably at least 2 mgKOH/g. As a result, the toner can exhibit a stable chargeability and good continuous image forming characteristic for a long period.

It is preferred that the low-molecular weight polymer component has an acid value $A_{VL}$, and the high-molecular weight polymer component has an acid value $A_{VH}$ satisfying $A_{VL}>A_{VH}$; further preferably the acid value $V_{VL}$ of the low-molecular weight polymer component is 21–35 mgKOH/g, and the acid value $A_{VH}$ of the high-molecular weight polymer component is 0.5–11 mgKOH/g, giving a difference satisfying $10\leqq(A_{VL}-A_{VH})\leqq27$.

As a result of our study, it has been found that, in the toner resin composition including a low-molecular weight polymer component and a high-molecular weight polymer component, if the respective polymer components have the above-mentioned acid values, it is effective to improve the low-temperature fixability, anti-offset characteristic, prevention of toner sticking onto the electrostatic image-bearing member and developing performance.

The low-temperature fixability is governed by the Tg and molecular weight distribution of the low-molecular weight polymer component. If the low-molecular weight polymer component contains an acid component and the acid value thereof is larger than that of the high-molecular weight polymer component by 10 mgKOH/g or larger, the resultant resin composition can have a lower viscosity than a resin composition having identical Tg and identical molecular weight distribution but having an acid value falling outside the above-mentioned ranges.

This is presumably for the following reason. By setting the acid value (0.5–11 mgKOH/g) of the high-molecular weight polymer component to be lower by at least 10 mgKOH/g than that of the low-molecular weight polymer component, the entanglement of molecular chains between the low- and high-molecular weight polymer components is suppressed to some extent, so that it becomes possible to lower the viscosity at low temperatures and maintain the elasticity at high temperatures. These factors lead to an enhanced low-temperature fixability and an improved developing performance in a high-speed machine.

On the other hand, if the acid value difference exceeds 27 mgKOH/g, the miscibility between the low- and high-molecular weight components is liable to be impaired, thus resulting in lower anti-offset characteristic and developing performance in continuous image formation.

Further, in case where the low-molecular weight polymer component has an acid value of at least 21 mgKOH/g, the quick chargeability can be improved. On the other hand, if the acid value of the low-molecular weight polymer component exceeds 35 mgKOH/g, the developing performance in a high humidity environment is liable to be lowered.

In case where the high-molecular weight polymer component has an acid value below 0.5 mgKOH/g, the miscibility thereof with the low-molecular weight polymer component (having an acid value of 21–35 mgKOH/g) can be impaired, thus being liable to provide an inferior developing performance, particularly liable to cause fog.

The polymer components may preferably have a ratio of acid value/total acid value of at most 0.7, more preferably 0.4–0.6. If the ratio of acid value/total acid value exceeds 0.7, the balance in toner chargeability (i.e., balance between triboelectric charge and discharge) favors an enhanced charge, thus being liable to cause a lower charging stability.

It is preferred that the polymer components (more specifically, THF-soluble content thereof) provide a GPC chromatogram showing a minimum in a molecular weight region of from $3\times10^4$ to below $1\times10^5$. In order to provide a combination of low-temperature fixability and high-temperature anti-offset characteristic, it is preferred that the low-molecular weight polymer component and the high-molecular weight polymer component form separate molecular weight distributions.

In the polymer components of the toner, it is preferred that the low- and high-molecular weight polymer components are blended in $W_L$ and $W_H$ wt. parts, respectively, satisfying a ratio $W_L:W_H$=50:50–90:10. This is because a ratio of the low- and high-molecular weight polymer components outside the range is liable to provide inferior fixability and anti-offset characteristic. More specifically, if the low-molecular weight polymer component is below 50 wt. % the fixability is lowered. On the other hand, if the high-molecular weight polymer component is below 10 wt. %, the high-temperature anti-offset characteristic is lowered.

Further, it is preferred that the mixing amounts and the acid values satisfy the following relationships:

$$A_{VL}\times W_L/(W_L+W_H)\geqq A_{VH}\times(W_H/(W_L+W_H))\times4$$

$$11\leqq(A_{VL}W_L+A_{VH}W_H)/(W_L+W_H)\leqq30.$$

This is for the following reasons. Non-satisfaction of the upper formula means $A_{VL}\times W_L/(W_L+W_H)<A_{VH}\times(W_H/(W_L+W_H))\times4$. Thus, the acid value of the low-molecular weight component in the resin composition is below 4 times the acid value of the high-molecular weight component in the resin composition, whereby the miscibility between the low-molecular weight component and the high-molecular weight component is enhanced, so that it becomes difficult to separately exhibit the low viscosity at the low-temperature side and the high viscosity at the high-temperature side.

Further, in case where $(A_{VL}W_L+A_{VH}W_H)/(W_L+W_H)$ is below 11, the quick chargeability can be impaired. On the other hand, in exceeds of 30, the developing performance in a high humidity environment is liable to be lowered.

The acid values (JIS acid value) of low- and high-molecular weight polymer components in a toner referred to herein are based on values measured in the following manner.

Collection of the respective components

[Apparatus organization]

LC-908 (mfd. by Nippon Bunseki Kogyo K.K.)

JRS-86 (do.; repeat injector)

JAR-2 (do.; auto-sampler)

FC-201 (mfd. by Gilson Corp.: fraction collector)

[Column organization]

JAIGEL-1H to 5H (20 mm-dia.×600 mm-L, fraction-collection column)

[Measurement conditions]

Temperature: 40° C.,

Solvent: THF,

Flow rate: 5 ml/min.,

Detector: R.I.

A sample toner is preliminarily subjected to separation of additives other than polymer components. For the fraction collection, an elusion time corresponding to a molecular weight of $5\times10^4$ is measured in advance, and a low-molecular weight polymer component and a high-molecular weight polymer component are recovered before and after the elution time, respectively. The solvent is removed from the recovered (fractionated) samples to provide samples for acid value measurement in the following manners.

Measurement of acid value ($A_V$=JIS acid value)

1) 0.1–0.2 g of a sample in a pulverized form is accurately weighed at W (g).
2) The sample is placed in a 20 cc-Erlenmeyer flask, and 10 cc of a toluene/ethanol (=2/1) mixture is added thereto to dissolve the sample.
3) Several drops of phenolphthalein alcohol solution are added as an indicator.
4) The solution in the flask is titrated with a 0.1 normal-KOH alcohol solution added through a buret. The volume of the KOH solution used for the titration is read at S (ml).

Separately, a blank titration is performed to read the KOH solution at this time at B (ml).

5) The acid value ($A_V$) is calculated by the following equation.

Acid value $(A_V)=(S-B)\times f\times 5.61/W$, wherein f denotes the factor of the KOH solution.

Measurement of total acid value ($TA_V$)

1) Ca. 2 g of a sample is accurately weighed at W' (g).
2) The sample is placed in a 200 cc-Erlenmeyer flask, and 30 cc of 1,4-dioxane, 10 cc of pyridine and 20 mg of 4-dimethylaminopyrimidine are added thereto.
3) 3.5 cc of deionized water is added, and the content is refluxed for 4 hours and then cooled.
4) Several drops of phenolphthalein alcohol solution are added as an indicator.
5) The solution in the flask is titrated with a 0.1 normal-KOH solution in THF added through a buret. The volume of the KOH solution used for the titration is read at S' (ml).

Separately, a blank titration is performed to read the KOH solution at this time at B' (ml).

6) The total acid value ($TA_V$) is calculated by the following equation.

$$\text{Total acid value } (TA_V)=(S'-B')\times f'\times 5.61/W',$$

wherein f' denotes the factor of the KOH solution.

The above-mentioned KOH solution in THF may be prepared by dissolving 6.6 g of KOH in 20 cc of deionized water and adding 720 cc of THF (tetrahydrofuran) and 100 cc of deionized water, followed by addition of methanol until the system becomes transparent.

Examples of the monomer (carboxyl group-containing monomer) used for adjusting the acid values of the polymer components may include: acrylic acid and α- or β-alkyl derivatives, such as acrylic acid, methacrylic acid, α-ethylacrylic acid, and crotonic acid; and unsaturated dicarboxylic acids, such as fumaric acid, maleic acid and citraconic acid, and mono-ester derivatives thereof. Desired polymers may be synthesized by polymerizing these monomers alone or in mixture, or by copolymerization of these monomers with other monomers. Among these, it is particularly preferred to use mono-ester derivatives of unsaturated dicarboxylic acids in order to control the ratio of acid value/total acid value.

Preferred examples of the acidic or carboxyl group-containing monomer may include: monoesters of α,β-unsaturated dicarboxylic acids, such as monomethyl maleate, monoethyl maleate, monobutyl maleate, monooctyl maleate, monoallyl maleate, monophenyl maleate, monomethyl fumarate, monoethyl fumarate, monobutyl fumarate and monophenyl fumarate; monoesters of alkenyldicarboxylic acids, such as monobutyl n-butenylsuccinate, monomethyl n-octenylsuccinate, monoethyl n-butenylmalonate, monomethyl n-dodecenylglutarate, and monobutyl n-butenyladipate; and monoesters of aromatic dicarboxylic acids, such as monomethyl phthalate, monoethyl phthalate and monobutyl phthalate.

The above-mentioned carboxyl group-containing monomer may preferably constitute 1–20 wt. %, particularly 3–15 wt. %, of the total monomers providing a polymer component of the binder resin.

A dicarboxylic acid monoester is preferred in preparation of a polymer component in an aqueous medium because acid monomer having a high solubility in an aqueous suspension medium is not suitable but an ester having a lower solubility is preferred in suspension polymerization.

The carboxylic acid group and carboxylic acid ester cite can be subjected to saponification by an alkaline treatment. It is also preferred to convert the carboxylic acid group and the carboxylic acid ester cite into a polar functional group by reaction with an alkaline cationic component. This is because, even if a carboxylic group potentially capable of reacting with a metal-containing organic compound is contained in a polymer component, the crosslinking efficiency thereof is lowered, if the carboxylic acid group is in the form of an anhydride, i.e., cyclized.

The alkaline treatment may be performed by adding an alkali into the solvent medium after the preparation of the binder resin. Examples of the alkali may include: hydroxides of alkaline metal or alkaline earth metals, such as Na, K, Ca, Li, Mg and Ba; hydroxides of transition metals such as Zn, Ag, Pb and Ni; and ammonium hydroxide, alkylammonium hydroxides, such as pyridinium hydroxide. Particularly preferred examples may include NaOH and KOH.

The above-mentioned saponification need not be effected with respect to all the carboxylic acid group and carboxylic ester cite of the copolymer, but a part of the carboxylic groups can be saponified into a polar functional group.

The alkali for the saponification may be used in an amount of 0.02–5 equivalents to the acid value of the binder resin. Below 0.02 equivalent, the saponification is liable to be insufficient to provide insufficient polar functional groups, thus being liable to cause insufficient crosslinking thereafter. On the other hand, in excess of 5 equivalents, the functional group, such as the carboxylic ester cite, can receive adverse effects, such as hydrolysis and salt formation.

If the alkalline treatment in an amount of 0.02–5 equivalents to the acid value is effected, the remaining cation concentration may be within the range of 5–1000 ppm.

The toner composition may preferably have a glass transition temperature (Tg) of 50°–70° C., more preferably 55°–65° C. in view of the storability. If Tg is below 50° C., the deterioration in a high temperature environment and offset at the time of fixation of the toner may be caused. If Tg is above 70° C., the fixability is liable to be lowered.

The low-molecular weight polymer component and the high-molecular weight polymer component may preferably have $Tg_L$ and $Tg_H$, respectively, satisfying $Tg_L \geqq Tg_H-5$ (°C.). In case of $Tg_L<Tg_H-5$, the developing performance is liable to be lowered. $Tg_L \geqq Tg_H$ is further preferred.

The binder resin (polymer component mixture) of the toner may be obtained through various processes, inclusive of: a solution blend process wherein a high-molecular weight polymer and a low-molecular weight polymer produced separately are blended in solution, followed by removal of the solvent; a dry blend process wherein the high- and low-molecular weight polymers are melt-kneaded by means of, e.g., an extruder; and a two-step polymerization process wherein a low-molecular weight polymer prepared, e.g., by solution polymerization is dissolved in a monomer constituting a high-molecular weight polymer, and the resultant solution is subjected to suspension polymerization, followed by washing with water and drying to obtain a binder resin. However, the dry blend process leaves a problem regarding the uniform dispersion and mutual solubilities, and the two-step polymerization process makes it difficult to increase the low-molecular weight component in excess of the high-molecular weight component while it is advantageous in providing a uniform dispersion. Further, the two-step polymerization process providing a difficulty that, in the presence of a low-molecular weight polymer component, it is difficult to form an adequately high-molecular weight component and an unnecessary low-molecular weight component is by-produced. Accordingly, the solution blend process is most suitable in the present invention. In order to introduce a prescribed acid value into the low-molecular weight polymer component, the solution polymerization method allowing easy setting of acid value is preferred than the polymerization method in an aqueous medium.

The high-molecular weight component in the binder resin composition used in the present invention may be produced by solution polymerization, emulsion polymerization or suspension polymerization.

In the emulsion polymerization process, a monomer almost insoluble in water is dispersed as minute particles in an aqueous phase with the aid of an emulsifier and is polymerized by using a water-soluble polymerization initiator. According to this method, the control of the reaction temperature is easy, and the termination reaction velocity is small because the polymerization phase (an oil phase of the vinyl monomer possibly containing a polymer therein) constitute a separate phase from the aqueous phase. As a result, the polymerization velocity becomes large and a polymer having a high polymerization degree can be prepared easily. Further, the polymerization process is relatively simple, the polymerization product is obtained in fine particles, and additives such as a colorant, a charge control agent and others can be blended easily for toner production. Therefore, this method can be advantageously used for production of a toner binder resin.

In the emulsion polymerization, however, the emulsifier added is liable to be incorporated as an impurity in the polymer produced, and it is necessary to effect a post-treatment such as salt-precipitation in order to recover the product polymer at a high purity. The suspension polymerization is more convenient in this respect.

The suspension polymerization may preferably be performed by using at most 100 wt. parts, preferably 10–90 wt. parts, of a monomer (mixture) per 100 wt. parts of water or an aqueous medium. The dispersing agent may include polyvinyl alcohol, partially saponified form of polyvinyl alcohol, and calcium phosphate, and may preferably be used in an amount of 0.05–1 wt. part per 100 wt. parts of the aqueous medium. The polymerization temperature may suitably be in the range of 50°–95° C. and selected depending on the polymerization initiator used and the objective polymer.

The high-molecular weight polymer component in the resin composition may preferably be produced in the presence of a polyfunctional polymerization initiator alone or in combination with a monofunctional polymerization initiator, as enumerated hereinbelow.

Specific examples of the polyfunctional polymerization initiator may include: polyfunctional polymerization initiators having at least two functional groups having a polymerization-initiating function, such as peroxide groups, per molecule, inclusive of 1,1-di-t-butylperoxy-3,3,5-trimethylcyclohexane, 1,3-bis-(t-butylperoxyisopropyl) benzene, 2,5-dimethyl-2,5-(t-butylperoxy)hexane, 2,5-dimethyl-2,5-di-(t-butylperoxy)hexine-3, tris(t-butylperoxy)triazine, 1,1-di-t-butylperoxycyclohexane, 2,2-di-t-butylperoxybutane, 4,4-di-t-butylperoxyvaleric acid n-butyl ester, di-t-butylperoxyhexahydroterephthalate, di-t-butylperoxyazelate, di-t-butylperoxytrimethyladipate, 2,2-bis-(4,4-di-t-butylperoxycyclohexyl)propane, 2,2-t-butylperoxyoctane and various polymer oxides; and polyfunctional polymerization initiators having both a polymerization-initiating functional group, such as peroxide group, and a polymerizable unsaturation group in one molecule, such as diallylperoxydicarbonate, t-butylperoxymaleic acid, t-butylperoxyallylcarbonate, and t-butylperoxyisopropylfumarate.

Among these, particularly preferred examples may include: 1,1-di-t-butylperoxy-3,3,5-trimethylcyclohexane, 1,1-di-t-butylperoxycyclohexane, di-t-butylperoxyhexahydroterephthalate, di-t-butylperoxyazelate, 2,2-bis(4,4-di-t-butylperoxycyclohexyl) propane, and t-butylperoxyallylcarbonate.

These polyfunctional polymerization initiators may preferably be used in combination with a monofunctional polymerization initiator, preferably one having a 10 hour-halflife temperature (a temperature providing a halflife of 10 hours by decomposition thereof) which is lower than that of the polyfunctional polymerization initiator, so as to provide a toner binder resin satisfying various requirements in combination.

Examples of the monofunctional polymerization initiator may include: organic peroxides, such as benzoyl peroxide, 1,1-di(t-butylperoxy)-3,3,5-trimethylcyclohexane, n-butyl-4,4-di(t-butylperoxy)valerate, dicumyl peroxide, α,α'-bis(t-butylperoxydiisopropyl)benzene, t-butylperoxycumene and di-t-butyl peroxide; and azo and diazo compounds, such as azobisisobutyronitrile, and diazoaminoazobenzene.

The monofunctional polymerization initiator can be added to the monomer simultaneously with the above-mentioned polyfunctional polymerization initiator but may preferably be added after lapse of a polymerization time which exceeds the halflife of the polyfunctional polymerization initiator, in order to appropriately retain the initiator efficiency of the polyfunctional polymerization initiator.

The above-mentioned polymerization initiators may preferably be used in an amount of 0.05–2 wt. parts per 100 wt. parts of the monomer in view of the efficiency.

The high-molecular weight polymer component of the resin composition used in the present invention may preferably be crosslinked with a crosslinking monomer as enumerated hereinbelow so as to satisfy the required properties according to the present invention.

The crosslinking monomer may principally be a monomer having two or more polymerizable double bonds. Specific examples thereof may include: aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl) propanediacrylate, polyoxyethylene(4)-2,2-bis(4-hydroxyphenyl)propanediacrylate, and compounds obtained by substituting methacrylate groups for the acrylate groups in the above compounds; and polyester-type diacrylate compounds, such as one known by a trade name of MANDA (available from Nihon Kayaku K.K.). Polyfunctional crosslinking agents, such as pentaerythritol triacrylate, trimethylethane triacrylate, tetramethylolmethane tetracrylate, oligoester acrylate, and compounds obtained by substituting methacrylate groups for the acrylate groups in the above compounds; triallyl cyanurate and triallyl trimellitate.

These crosslinking agents may preferably be used in a proportion of 1 wt. part or less, particularly about 0.001–0.05 wt. parts, per 100 wt. parts of the other vinyl monomer components.

Among the above-mentioned crosslinking monomers, aromatic divinyl compounds (particularly, divinylbenzene) and diacrylate compounds connected with a chain including an aromatic group and an ether bond may suitably be used in a toner resin in view of fixing characteristic and anti-offset characteristic.

On the other hand, the low-molecular weight polymer component within the binder resin, may be produced through a known process. According to the bulk polymerization, however, such a low-molecular weight polymer can be produced by adopting a high polymerization temperature providing an accelerated reaction speed, the reaction cannot be controlled easily. In contrast thereto, according to the solution polymerization process, such a low-molecular weight polymer can be produced under moderate conditions by utilizing the radical chain transfer function of the solvent and by adjusting the polymerization initiator amount or reaction temperature, so that the solution polymerization process is preferred for formation of the low-molecular weight component in the binder resin. It is also effective to perform the solution polymerization under an elevated pressure, so as to suppress the amount of the polymerization initiator to the minimum and suppress the adverse effect of the residual polymerization initiator.

Examples of the monomer constituting the high-molecular weight polymer component and the low-molecular weight polymer component in the binder resin may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; the esters of the above-mentioned $\alpha,\beta$-unsaturated acids and the diesters of the above-mentioned dibasic acids. These vinyl monomers may be used singly or in combination of two or more species.

Among these, a combination of monomers providing styrene-polymers or styrene copolymers inclusive of styrene-acrylic type copolymers may be particularly preferred.

It is further preferred that both the low- and high-molecular weight polymer components contain at least 65 wt. % of polymerized styrene units in the form of styrene homopolymer or styrene copolymers in view of miscibility therebetween.

If the high-molecular weight polymer component constituting a toner binder resin composition is blended with a low-molecular weight wax in advance, the phase separation in micro-domains can be alleviated to prevent re-agglomeration of the high-molecular weight polymer component and provide a good dispersion state with the low-molecular weight polymer component.

Examples of such low-molecular weight wax may include: polypropylene wax, polyethylene wax, microcrystalline wax, carnauba wax, sasol wax, paraffin wax, higher alcohol wax, ester wax, and oxides and graft-modified products thereof.

These low-molecular weight waxes may preferably have a weight-average molecular weight of at most $3\times10^4$, more preferably at most $10^4$ further preferably 800–9000. The addition amount thereof may preferably be about 1–20 wt. parts per 100 wt. parts of the binder polymer component.

In toner production, the low-molecular weight wax can be added to and mixed with the binder resin in advance. It is also possible to preliminarily dissolve the wax and the high-molecular weight polymer in a solvent, and mix the resultant solution with a solution of the low-molecular weight polymer, thereby producing a binder resin.

Such polymer solutions may for example have a solid content of 5–70 wt. % in view of dispersion efficiency, prevention of denaturation of the resin under stirring and operability. More particularly, the preliminary solution of the high-molecular weight polymer component and the wax may for example have a solid content of 5–60 wt. %, and the low-molecular weight polymer solution may for example have a solid content of 5–70 wt. %.

The high-molecular weight polymer component and the wax may be dissolved or dispersed under stirring either batchwise or continuously to prepare the preliminary solution.

The blending with the low-molecular weight polymer solution may be performed by blending the low-molecular weight polymer solution in an amount of 10–1000 wt. parts with the preliminary solution containing 100 wt. parts of the solid content. The blending may be performed either batchwise or in a continuous manner.

Examples of the organic solvent used for the solution blending for preparation of the resin composition may include: hydrocarbon solvents, such as benzene, toluene, xylene, solvent naphtha No. 1, solvent naphtha No. 2, solvent naphtha No. 3, cyclohexane, ethylbenzene, Solvesso 100, Solvesso 150 and mineral spirit; alcohol solvents, such as methanol, ethanol, iso-propyl alcohol, n-butyl alcohol, sec-butyl alcohol, iso-butyl alcohol, amyl alcohol, and cyclohexanol; ketone solvents, such as acetone, methyl ethyl ketone, methyl isobutyl ketone, and cyclohexanone; ester solvents, such as ethyl acetate, n-butyl acetate, and cellosolve acetate; and ether solvents, such as methyl cellosolve, ethyl cellosolve, high cellosolve and methyl carbitol. Among these, aromatic, ketone and/or ester solvents may be preferred. These solvents can be used in mixture.

The organic solvent may preferably be removed by removing 10–80 wt. % thereof by heating the polymer solution under a normal pressure and removing the remainder under a reduced pressure. In this instance, it is preferred to retain the polymer solution at a temperature which is at least the boiling point of the solvent and at most 200° C. Below the boiling point, not only the efficiency of the solvent removal is lowered, but also the polymers within the organic solvent receive an unnecessary shearing force to promote re-distribution of the. component polymers, thus being liable to cause microscopic phase separation. In excess of 200° C., the de-polymerization of the polymerization is liable to occur, thus not only resulting in oligomers due to molecular severance but also being liable to result in monomers which may be entrained into the product resin.

The toner particles used in the present invention may preferably be in the form of magnetic toner particles containing a magnetic material. The magnetic material may preferably be a magnetic iron oxide, particularly a silicon-containing magnetic iron oxide.

The silicon content in the magnetic iron oxide may preferably be 0.1–5.0 wt. %, more preferably 0.4–2.0 wt. %, further preferably 0.5–0.9 wt. %, based on the iron.

The use of a silicon-containing magnetic material provides a toner having excellent flowability, whereby the chargeability of the toner is stabilized to provide an improved continuous image forming characteristic. Further, toner particles containing a silicon-containing magnetic material exerts a very mild abrasive effect on the image-bearing member surface, so that, even when the toner particles begin to stick onto the image-bearing member surface, the surface is moderately abraded before complete sticking, thus improving the continuous image forming characteristic of the image-bearing member.

The silicon content in magnetic iron oxide particles referred to herein is based values measured by using a fluorescent X-ray analyzer ("SYSTEM 3080", available from Rikagaku Denki Kogyo K.K.) according to JIS K0119 (General Rules of Fluorescent X-ray Analysis).

The magnetic iron oxide particles constituting the magnetic toner may preferably be used in an amount of 20–200 wt. parts, more preferably 30–150 wt. parts per 100 wt. parts of the binder resin.

The magnetic iron oxide particles may have been surface-treated with a silane coupling agent, a titanate coupling, a titanate, an aminosilane or an organic silicon compound, as desired.

The toner may contain a known colorant, such as carbon black, a pigment, such as copper phthalocyanine, or a dye.

The toner can also contain a charge control agent. Examples of negative charge control agents may include: metal complexes of monoazo dyes, salicylic acid, alkylsalicylic acid, dialkylsalicylic acid, and naphthoic acid. Examples of positive charge control agents may include: nigrosine dyes, azine dyes, triphenylmethane dyes, imidazole compounds, quaternary ammonium salts, and polymers having such a quaternary ammonium salt as their side groups.

The toner according to the present invention may be produced by sufficiently mixing the polymer components, a pigment or dye or magnetic material as colorant, a charge controller, another additive, etc., by means of a mixer such as a ball mill, etc.; then melting and kneading the mixture by hot kneading means such as hot rollers, kneader and extruder to disperse or dissolve the additives, in the melted resin (polymer components); cooling and pulverizing the mixture; and subjecting the powder product to precise classification to form the toner particles according to the present invention.

Alternatively, it is also possible to provide a toner through polymerization. According to the polymerization method, a polymerizable monomer, a charge-controlling agent, a pigment, dye or magnetic material, a polymerization initiator, and optionally a crosslinking agent, and other additives, as desired, may be uniformly dissolved or dispersed to form a monomer composition. Then, the monomer composition or a preliminarily polymerized product thereof is dispersed in a continuous phase (e.g., of water) by means of an appropriate stirrer, and then subjected to polymerization to recover magnetic toner particles having a desired particle size.

FIG. 1 illustrates an example of image forming apparatus, and an embodiment of the image forming method according to the present invention will be described based thereon.

Referring to FIG. 1, the image forming apparatus includes a photosensitive drum 1 as an electrostatic image-bearing member in the form of a rotating drum, around which are sequentially disposed, a primary charging device 2 comprising a contact-charging member such as a charging roller, an exposure optical system 3, a developing device 4 including a toner-carrying member (developing sleeve) 5, a transfer device 9, and a cleaning device 11.

In the image forming apparatus, the surface of the photosensitive drum 1 is uniformly charged by the primary charger 2 and exposed to imagewise light 3 to form an electrostatic latent image thereon.

Separately, on the surface of the toner-carrying member 5 enclosing a magnet therein, a layer of a toner according to the present invention is formed by means of a toner layer thickness-regulating member 6. At a developing position, an alternating bias voltage, a pulse bias voltage and/or a DC bias voltage is applied between the photosensitive drum 1 and the toner-carrying member 5 by a bias voltage-application means 8 to develop the electrostatic image on the photosensitive drum 1 with the toner on the toner-carrying member 5 to form a toner image thereon.

At a transfer position, the toner image on the photosensitive drum 1 is electrostatically transferred onto transfer-receiving paper P conveyed thereto under the action of a charge of a polarity opposite to that of the toner supplied to a lower surface (as indicated) of the paper P via a transfer device 9 from a voltage application means 10.

The transfer paper P carrying the transferred toner image is caused to pass through a hot-pressure roller fixing device 12 whereby the toner image is fixed onto the paper P to form a fixed toner image thereon.

Residual toner remaining on the photosensitive drum 1 after the transfer step is removed by the cleaning device, and the cleaned photosensitive drum 1 is subjected to a subsequent image forming cycle starting from the primary charging step.

The electrostatic image-bearing member has a laminated structure including at least an electroconductive support, a charge generation layer and a charge transport layer, and further preferably an utmost surface layer containing fluorine and/or silicon atom so as to provide a longer life and prevent ununiform abrasion of the image-bearing member surface.

The fluorine atom for the above-purpose may be supplied as a fluorine-containing compound, e.g., a fluorine-containing resin, examples of which may include homopolymers and copolymers of tetrafluoroethylene, trifluorochloroethylene, hexafluoropropylene, vinyl fluoride, vinylidene fluoride, and difluorodichloroethylene. These may be used singly or in combination of two or more species. Fluorinated carbon can also be used.

It is also possible to use another fluorine-containing polymer or a block or graft copolymer having a fluorine-containing segment formed together with non-fluorine-containing monomer, or a fluorine-containing surfactant or macro-monomer alone or in combination with the above-mentioned fluorine-containing resin.

Examples of silicon-containing compound as sources of the above-mentioned silicon atom may include: monomethylsiloxane three-dimensionally crosslinked product, dimethylsiloxane-monomethyl-siloxane three-dimensionally crosslinked product, ultra-high molecular weight polydimethylsiloxane, block polymer having polydimethylsiloxane segment, surfactants, macromonomers, and terminal-modified polydimethylsiloxane. A three-dimensionally crosslinked product may be used in the form of fine particles having a particle size in the range of 0.01–5 μm. The polydimethylsiloxane compound may preferably have a molecular weight of $3\times10^3$–$5\times10^6$.

Such a source compound in a fine particulate form may be dispersed together with a binder resin to form a photosensitive layer-forming composition.

The fluorine- or silicon-source compound may preferably be used in a proportion of at most 50 wt. more preferably 0.5–50 wt. % of an organic photoconductor (OPC) layer-forming composition.

If such a fluorine and/or silicon-atom is present at the surface layer of the electrostatic image-bearing member, the surface energy of the image-bearing member can be lowered whereby the toner is less liable to be attached. If the content is too large, the frictional coefficient with the cleaning member can be excessively lowered to adversely result in toner passing-by and cleaning failure.

Figure 5:
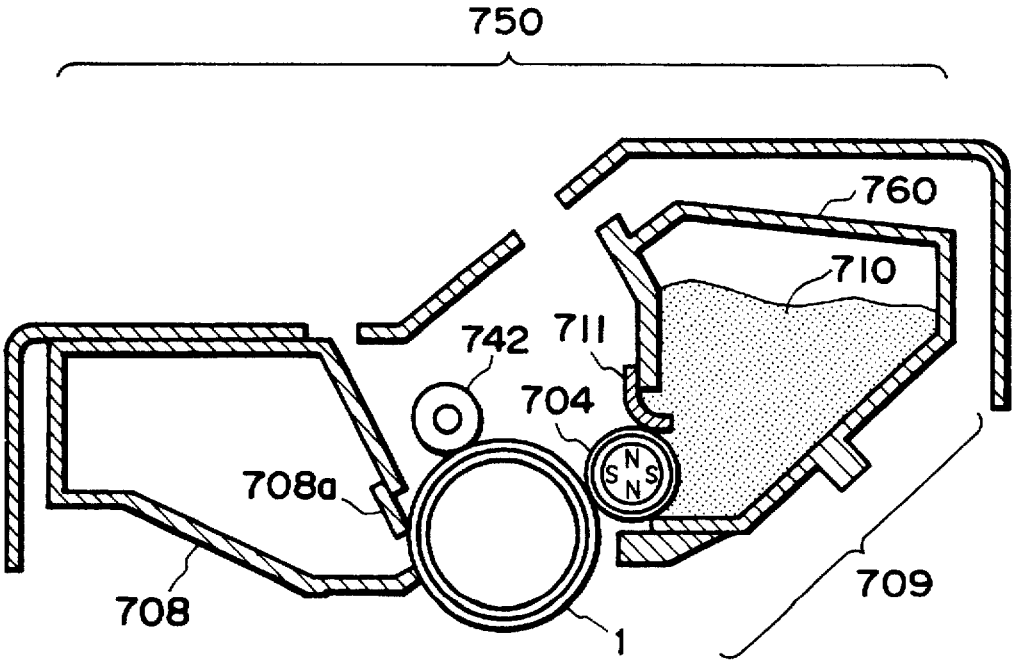
FIG. 5 is an illustration of an embodiment of the apparatus unit according to the invention.

FIG. 5 shows an embodiment of the apparatus unit (process cartridge) according to the present invention. The apparatus unit includes at least a developing means and an electrostatic image-bearing member integrally assembled into a cartridge, which is detachably mountable to a main assembly of an image forming apparatus (such as a copying machine, or a laser beam printer).

In this embodiment, an apparatus unit (process cartridge) 750 is shown to integrally include a developing means 709, a drum-shaped electrostatic image-bearing member (photosensitive drum) 1, a cleaner 708 having a cleaning blade 708*a*, and a primary charger (charging roller) 742.

In the cartridge of this embodiment, the developing means 709 comprises an elastic blade 711 and a toner 760 containing a magnetic toner 710. The magnetic toner is used for development in such a manner that a prescribed electric field is formed between the photosensitive drum 1 and a developing sleeve 704. In order to perform the development suitably, it is very important to accurately control the spacing between the photosensitive drum 1 and the developing sleeve 704.

Figure 2:
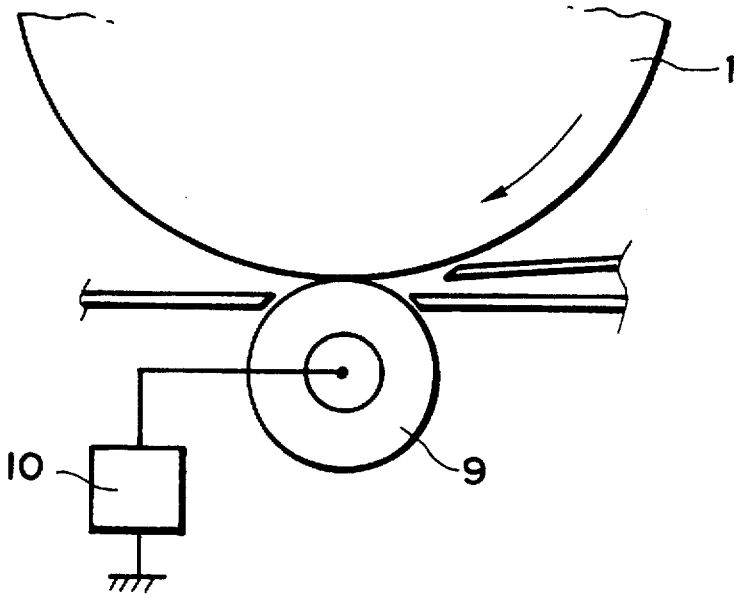
FIG. 2 is an illustration of a transfer means suitably used in an image forming method according to the invention.

On the other hand, the charging member 742 (or 2 in FIGS. 1 and 2) may preferably have an ASKER-C hardness of at least 60 deg., more preferably at most 55 deg., so as to provide a sufficient contact width with the electrostatic image-bearing member 1 (member to be charged) under a weak pressing force, generate little ozone and cause little noise even when the charging member is supplied with a voltage comprising an AC component.

In order to provide an ASKER-C hardness of at most 60 deg., the charging member 2 may preferably comprise a lower layer structure including an elastomeric layer (2*b*) comprising a thermoplastic elastomer or a soft rubber, and an electroconductive layer (2*a*, as show in FIG. 3), or a lower layer structure comprising an electroconductive sponge.

On the other hand, the uppermost layer (2*c* in FIG. 3) of the charging member 2 contacting the electrostatic image-bearing member may comprise a layer of 50–200 μm in thickness comprising a highly resistive material so as to exhibit a stable chargeability without causing a leakage current.

Hereinbelow, the present invention will be described based on specific Examples.

[Production of Resin composition (I)]

Synthesis of Low-molecular weight polymer (L-1)

300 wt. parts of xylene was placed in a four-necked flask, and the interior of the flask was sufficiently aerated with nitrogen under stirring. Then, the xylene was heated and subjected to refluxing.

Under the refluxing condition, a mixture of 75 wt. parts of styrene, 18 wt. parts of n-butyl acrylate, 7 wt. parts of monobutyl maleate and 2 wt. parts of di-tert-butyl peroxide was added dropwise in 4 hours. The system was held for 2 hours to complete the polymerization to obtain a solution of Low-molecular weight polymer (L-1).

A part of the polymer solution was sampled and dried under a reduced pressure to recover Low-molecular weight polymer (L-1), which was then subjected to GPC (gel permeation chromatography) and measurement of glass transition temperature (Tg). As a result, the polymer (L-1) showed a weight-average molecular weight (Mw) of 9,600, a number-average molecular weight (Mn) of 6,000, a peak molecular weight (PMW) of 8,500, a Tg of 62° C., and an acid value ($A_V$) of 25.

The polymer conversion at that time was 98%.

Synthesis of High-molecular weight polymer (H-1)

In a four-necked flask, 180 wt. parts of degassed water and 20 wt. parts of 2 wt. % polyvinyl alcohol aqueous solution were placed, and then a mixture liquid of 70 wt. parts of styrene, 25 wt. parts of n-butyl acrylate, 5 wt. parts of monobutyl maleate, 0.005 wt. part of divinylbenzene and 0.1 wt. part of 2,2-bis(4,4-di-tert-butylperoxycyclohexyl) propane (a 10 hour-halflife temperature ($T_{10h}$)=92° C.) was added thereto, followed by stirring to form a suspension liquid.

The interior of the flask was sufficiently aerated with nitrogen, and then the system was heated to 85° C. to initiate the polymerization. After 24 hours at the temperature, 0.1 wt. part of benzoyl peroxide ($T_{10h}$=72° C.) was added, and the system was further held at the temperature for 12 hours to complete the polymerization.

To the suspension liquid after the reaction, an NaOH aqueous solution in an amount of 6 times equivalent to the acid value (AV=7.8) of the resultant High-molecular weight polymer (H-1) was added, and the system was stirred for 2 hours.

The resultant High-molecular weight polymer (H-1) was filtered out, washed with water, dried and, as a result of measurement, showed Mw=$1.8\times10^6$, PMW=$1.2\times10^6$ and Tg=62° C., and $A_V$=7.

Production of Resin composition

In a four-necked flask, 100 wt. parts of xylene, 25 wt. parts of the above High-molecular weight polymer (H-1) and 4 wt. parts of low-molecular weight polypropylene wax (Mw=6000) were placed and heated and stirred under reflux to effect preliminary dissolution. The system was retained for 12 hours in the state to obtain a preliminary solution (Y-1).

A portion of the preliminary solution was sampled and dried under a reduced pressure to recover a solid matter, which exhibited Tg=61° C.

Separately, 300 wt. parts of the above-mentioned uniform solution of Low-molecular weight polymer (L-1) was placed in another vessel and refluxed.

The above preliminary solution (Y-1) and Low-molecular weight polymer (L-1) solution were blended under reflux, followed by distilling-off of the organic solvent to recover a resin, which was then cooled and, after being solidified, pulverized to obtain Resin composition (I).

As a result of the measurement, Resin composition (I) showed PMW=$1.1\times10^6$, an areal percentage occupied by a molecular weight portion of $10^6$ or above on its GPC chromatogram (A($\geqq10^6$))=9.5%, Tg=62.5° C., and a THF-insoluble content (excluding the low-molecular weight polypropylene wax) of 2.0 wt. %.

EXAMPLE 1

(Toner Production Example 1)

| | |
|---|---|
| Resin composition (I) | 100 wt. parts |
| Magnetic iron oxide (Si content 0.8 wt. % (based on Fe) average particle size (Dav.) = 0.2 μm) | 100 wt. parts |
| Negative charge controlling agent (Azo-iron complex) | 3 wt. parts |

The above ingredients were melt-kneaded through a twin-screw extruder heated at 140° C. The kneaded product was cooled, coarsely crushed by a hammer mill and finely pulverized by a jet mill. The pulverized product was classified by a fixed wall pneumatic classifier to obtain coarsely classified powder, which was then subjected to classification by means of a multi-division classifier utilizing the Coanda effect ("Elbow Jet" classifier, available from Nittetsu Kogyo K.K.) to strictly remove ultra-fine powder and coarse powder simultaneously to obtain negatively chargeable magnetic toner particles having a weight-average particle size ($D_4$) of 6.5 μm (containing 0.2 wt. % of particles having a particle size of at least 12.7 μm and 12.0% by number of particles having a particle size of at most 3.17 μm).

The magnetic toner particles provided a GPC chromatogram showing a lower-molecular weight side peak value of 8,200 and a higher-molecular weight side peak value of $6.7\times10^5$, and showed acid value characteristics including $A_{VL}$=23, $A_{VH}$=7, and an acid value/total acid value ratio=0.44.

The above magnetic toner particles were blended with 1.2 wt. % of inorganic fine powder (hydrophobic silica) A-1 shown in Table 1, 0.08 wt. % of resin fine particles B-1 shown in Table 2 and 1.5 wt. % of metal oxide particles C-1shown in Table 3 by means of a Henschel mixer to prepare Toner I shown in Table 4. The metal oxide particles shown in Table 3 were prepared to have a specified particle size are a shape by sand-milling, as desired.

EXAMPLE 2–4

(Toner Production Examples 2–4)

Toners II–IV shown in Table 4 were prepared in the same manner as in Toner Production Example 1 except that inorganic fine powder A-1 or A-2, resin fine particles B-1 or B-2 and metal oxide particles C-1 or C-2 as shown in Tables 1–3, respectively, were used.

EXAMPLE 5

(Toner Production Example 5)

Toner V shown in Table 4 was prepared in the same manner as in Toner Production Example 1 except that Resin composition (I) was replaced by styrene-n-butyl acrylate copolymer, and the inorganic fine powder, the resin fine particles and metal oxide particles were replaced by those of A-3, B-5 and C-2 shown in Tables 1–3, respectively. The magnetic toner particles provided a GPC chromatogram showing a lower-molecular weight side peak value of 8300 and a higher-molecular weight side peak of $4\times10^5$; $A_{VL}$=0, $A_{VH}$=0; and a weight-average molecular weight ($D_4$)= 7.6 μm (containing 3.2 wt. % of particles having particle size of 12.7 μm or larger and 5.0% by number of particles having particle sizes of 3.17 μm or smaller).

EXAMPLE 6

(Toner Production Example 6)

Toner VI shown in Table 4 was prepared in the same manner as in Toner Production Example 1 except that Resin composition (I) was replaced by styrene-n-butyl acrylate-maleic anhydride copolymer having different acid values and molecular weight distribution, and the inorganic fine powder, the resin fine particles and metal oxide particles were replaced by those of A-1, B-3 and C-1 shown in Tables 1–3, respectively. The magnetic toner particles provided a GPC chromatogram showing a lower-molecular weight side peak value of $3.2\times10^4$ and a higher-molecular weight side peak of $7.3\times10^5$; $A_{VL}$=21, $A_{VH}$=7, an acid value/total acid value ratio of 0.46; and a weight-average molecular weight ($D_4$)=6.3 μm (containing 3.2 wt. % of particles having particle size of 12.7 μm or larger and 19.0% by number of particles having particle sizes of 3.17 μm or smaller).

Comparative Examples 1–5

(Comparative Toner Production Examples 1–5)

Comparative Toners i–v shown in Table 5 were prepared in the same manner as in Toner Production Example 1 except that inorganic fine powder A-1 or A-2, resin fine particles B-1 or B-2 and metal oxide particles C-1 or C-2 as shown in Tables 1–3, respectively, were used.

EXAMPLE 7

Toner I was charged in a developing vessel of an apparatus unit and incorporated in a laser beam printer (prepared by re-modeling a commercially available laser beam printer ("LBP-A309 GII", available from Canon K.K.) so as to increase the process speed from 16 A4-size sheets/min. to 30 A4-size sheets/min. (process speed of 140 mm/sec)) to evaluate the image forming performances.

The apparatus unit also included an organic photoconductor (OPC) drum having an utmost surface layer of OPC containing 25 wt. % of tetrafluoroethylene-hexafluoropropylene copolymer fine powder (prepared by emulsion polymerization to have Dav.=0.32 μm) (referred to as "photosensitive drum A").

Figure 3:
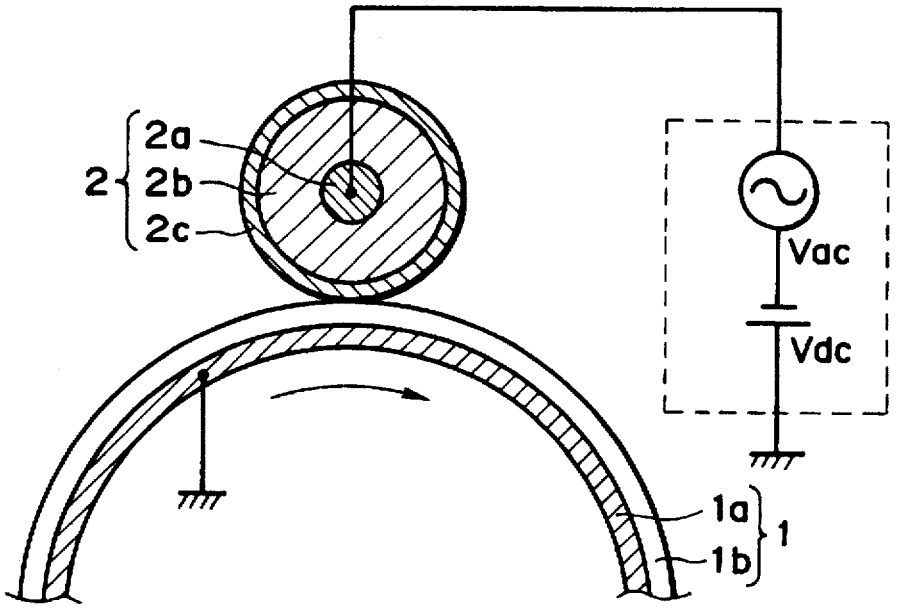
FIG. 3 is an illustration of a charging means suitably used in an apparatus unit and an image forming method according to the invention.

The apparatus unit also included a charging roller 2 as shown in FIG. 3 including an 8 mm-dia. core metal 2a, a lower layer 2b formed on the circumference of the core metal and a 150 μm-thick upper layer 2c so as to have an outer diameter of 15 mm. The charging roller exhibited an ASKER-C hardness of 45 deg. ( as an average of measured values at 9 points (three points each at the central position and two positions closer to the longitudinal ends) obtained by using an "ASKER-C Hardness Meter 100" at a load of 500 g).

The charging roller 2 was caused to contact the photosensitive drum 1 at a prescribed pressure and rotated following the rotation of the photosensitive drum 1. The charging roller 2 was supplied with a superposed voltage (Vac+Vdc) of an AC voltage (Vac, having a peak-to-peak voltage Vpp=1800 volts and a frequency Vf=1000 Hz) and a DC voltage (Vdc=−700 volts) so as to uniformly charge the photosensitive drum 1 at $V_D$=−700 volts.

The charging sound due to vibration between the charging roller 2 and the photosensitive drum 1 was at a level of practically no problem at all. Then, the charged surface of the photosensitive drum 1 was scanned with minute spots of laser beam depending on a prescribed image pattern to form an electrostatic latent image having a light-part potential $V_L$=−170 volts, which was then developed with a toner layer carried on a developing sleeve (5 in FIG. 1 or 704 in FIG. 5) under application of a developing bias voltage of Vac (Vpp=1400 volts and Vf=1800 Hz) superposed with Vdc (=−500 volts) between the photosensitive drum 1 and the developing sleeve 5, thereby forming a toner image on the photosensitive drum 1.

The thus-formed toner image on the photosensitive drum 1 was transferred onto a transfer(-receiving) paper by using a transfer roller 9 having an electroconductive elastomer layer abutted against the OPC drum at an abutting pressure of 50 g/cm so as to supply a positive charge onto a back surface of the transfer paper, and the transfer paper was caused to pass through a hot-pressure fixing device to form a fixed image thereon. At this time, the hot-pressure fixing device was driven at a heating roller surface temperature of 185° C., a total pressure of 5.5 kg between the heating roller and a pressure roller and a nip of 4 mm.

Under the above-set conditions, image-forming tests were formed in a low temperature/low humidity (15° C./10% RH) environment and in a high temperature/high humidity (32.5° C./80% RH) environment, at an intermittent printing cycle of 1 sheet/12 sec.

In the low temperature/low humidity environment, after taking an initial stage first sheet sample, an image of nine 5 mm-square solid black spots (arranged in 3 rows and 3 columns) was printed successively on 100 sheets for evaluation of the fixability. Thereafter, a $2\times10^4$ sheets of successively image forming test was performed while replenishing the toner as required for evaluation of the following items.

Evaluation (1) Image density

An image of 9 (=3×3) 5 mm-square solid black spots was printed on an ordinary plain paper for copying machine (75 g/m$^2$), and the density of the solid black spot portion was measured by a "Macbeth Reflection Densitomer" (available from Macbeth Co.) relative to a density of 0.00 allotted to a printed white background portion.

(2) Fixability

As mentioned above, in the low temperature/low humidity environment, an image of 9 (=3×3) 5 mm-square solid black spots were printed successively on 100 sheets after taking an initial stage first sheet sample, and the printed fixed image was rubbed with a soft tissue paper under a load of 50 g/cm$^2$, and the decrease in image density (%) was measured so as to evaluate fixability based on the worst value according to the following standard.

A (excellent): Below 5%.

B (good): 5% to below 10%.

C (fair): 10% to below 20%.

D (poor): 20% or higher.

(3) Anti-offset characteristic

A sample image having an area percentage of 5% was printed out, and the anti-offset characteristic was evaluated based on a degree of staining on images according to the following standard.

A (excellent): Not occurred at all.

B (good): Very slightly occurred.

C (fair): Slightly occurred.

D (poor): Staining on images remarkably occurred.

(4) Charging sound

The charging sound during printing was listened to at a distance of 50 cm from the main assembly and evaluated according to the following standard.

A (excellent): Not noticeable at all.

B (good): Almost unnoticeable.

C (fair): Noticeable to some extent.

D (poor): Considerably noticeable.

(5) Image flow

In the high temperature/high humidity environment, a $2\times10^4$ sheets of successive image forming test was performed while replenishing the toner as required for evaluation of image flow according to the following standard.

A (excellent): Not occurred at all.

B (good): Very slightly occurred.

C (fair): Slightly occurred.

D (poor): Remarkably occurred to blur the entire image.

(6) Toner sticking onto the photosensitive drum surface

The surface of the photosensitive drum after the $2\times10^4$ sheets of successive image formation in the high temperature/high humidity environment was evaluated with eyes in parallel with evaluation of resultant images according to the following standard:

A (excellent): Not occurred at all.

B (good): Slightly occurred but not affected the images.

C (fair): Sticking noticeably occurred but little affected the images.

D (poor): Sticking remarkably occurred and affected the images.

The evaluation results are inclusively shown in Table 6 together with those of other Examples and Comparative Examples described hereinafter.

EXAMPLES 8–11

Toners II–V were evaluated in the same manner as in Example 7.

EXAMPLE 12

The evaluation of Toner I in Example 7 was repeated except for using a charging roller having a hardness of 59 deg.

EXAMPLE 13

The evaluation of Toner I in Example 7 was repeated except for using a charging roller having a hardness of 62 deg.

Comparative Examples 6–9

Toners i–iv were evaluated in the same manner as in Example 7.

Comparative Example 10

The evaluation in Example 7 was repeated except for using Comparative Toner v and a photosensitive drum similar to the photosensitive drum A used in Example 7 but having an utmost surface layer not containing the tetrafluoroethylene-hexafluoropropylene copolymer fine powder (referred to as "photosensitive drum ").

Comparative Example 11

The evaluation of Comparative Toner v in Comparative Example 10 was repeated except for using a charging roller having a hardness of 70 deg.

TABLE 1

| Inorganic fine powder (silica) | | | | |
|---|---|---|---|---|
| Name | Dav. (nm) | $S_{BET}$ ($m^2/g$) | Charge polarity | Treating*1 agent |
| A-1 | 27 | 110 | — | HMDE + DMSO |
| A-2 | 24 | 120 | — | DMSO |
| A-3 | 15 | 190 | — | None |
| A-4 | 100 | 30 | — | DMSO |

*1HMDE: hexamethyldisilazane
DMSO: dimethylsilicone oil

TABLE 2

| Resin fine particles | | | | | | | |
|---|---|---|---|---|---|---|---|
| Name | Dav. (μm) | SF1 | SF2 | $S_{BET}$ ($m^2/g$) | $V_R$(P) (ohm.cm) | Charge polarity | Composition:Monomers (wt. %) |
| B-1 | 0.60 | 130 | 160 | 10 | $4 \times 10^{10}$ | — | St/MMA/BA (55/35/10) |
| B-2 | 0.60 | 120 | 150 | 10 | $4 \times 10^{12}$ | — | St/MMA/BMA (65/20/15) |
| B-3 | 0.33 | 115 | 135 | 18 | $5 \times 10^{8}$ | — | St/MMA/2EHA (58/22/20) |
| B-4 | 0.09 | 105 | 109 | 50 | $4 \times 10^{12}$ | — | St/MMA/MBA (65/20/15) |
| B-5 | 0.54 | 130 | 160 | 11 | $8 \times 10^{15}$ | — | MMA/BA (85/15) |

TABLE 3

| Metal oxide particles | | | | | | |
|---|---|---|---|---|---|---|
| Name | Species | Dav. (μm) | SF1 | SF2 | $S_{BET}$ ($m^2/g$) | Charge polarity |
| C-1 | strontium titanate | 0.83 | 185 | 200 | 2.4 | + |
| C-2 | cerium oxide | 1.05 | 175 | 195 | 2.3 | + |
| C-3 | strontium titanate | 5.00 | 195 | 245 | 0.05 | + |
| C-4 | titanium oxide | 0.20 | 137 | 148 | 12.0 | − |

TABLE 4

| Toner | | | | | | | | | | | |
|---|---|---|---|---|---|---|---|---|---|---|---|
| | | Inorganic fine powder | | | Resin fine particles | | | Metal oxide particles | | | Toner |
| Example No. | Toner | | Amount (wt. %) | Charge polarity | | Amount (wt. %) | Charge polarity | | Amount (wt. %) | Charge polarity | charge polarity |
| Ex. 1 | I | A-1 | 1.2 | − | B-1 | 0.08 | − | C-1 | 1.0 | + | − |
| Ex. 2 | II | A-1 | 1.2 | − | B-1 | 0.12 | − | C-2 | 1.5 | + | − |
| Ex. 3 | III | A-1 | 1.5 | − | B-2 | 0.40 | − | C-1 | 0.5 | + | − |
| Ex. 4 | IV | A-2 | 1.5 | − | B-2 | 0.07 | − | C-1 | 1.3 | + | − |
| Ex. 5 | V | A-3 | 1.5 | − | B-5 | 0.25 | − | C-2 | 1.5 | + | − |
| Ex. 6 | VI | A-1 | 1.2 | − | B-3 | 0.08 | − | C-1 | 1.4 | + | − |

TABLE 5

| | | Comparative Toner | | | | | | | | | |
|---|---|---|---|---|---|---|---|---|---|---|---|
| | | Inorganic fine powder | | | Resin fine particles | | | Metal oxide particles | | | Toner |
| Example No. | Comp. toner | | Amount (wt. %) | Charge polarity | | Amount (wt. %) | Charge polarity | | Amount (wt. %) | Charge polarity | charge polarity |
| Comp. Ex. 1 | i | A-4 | 1.3 | − | B-1 | 0.05 | − | C-1 | 1.4 | + | — |
| Comp. Ex. 2 | ii | A-2 | 1.2 | − | B-4 | 0.07 | − | C-1 | 1.4 | + | — |
| Comp. Ex. 3 | iii | A-2 | 1.2 | − | B-1 | 0.07 | − | C-3 | 1.2 | + | — |
| Comp. Ex. 4 | iv | A-2 | 1.2 | − | B-1 | 0.07 | − | C-4 | 1.2 | − | — |
| Comp. Ex. 5 | v | A-2 | 1.2 | − | — | — | − | C-2 | 1.4 | − | — |

TABLE 6

| | | | | Evaluation results | | | | | | | | | |
|---|---|---|---|---|---|---|---|---|---|---|---|---|---|
| | | | | | | | Evaluation results | | | | | | |
| | | Charge | | 15° C./10% RH | | | 15° C./10% PH | | | | | 32.5° C./80% RH | |
| | | roller | Photo- | (on 2 × $10^4$ sheets) | | | | Charge | | | | | |
| Ex. No. | Toner | hardness (deg.) | sensitive drum | Initial stage | Final stage | Fog (%) | Charge sound | roller soiling | Fixa-bility | Anti-offset | Drum abration | Image flow | Toner sticking |
| Ex. | | | | | | | | | | | | | |
| 7 | I | 45 | A | 1.45 | 1.42 | 1.8 | A | A | A | A | A | A | A |
| 8 | II | 45 | A | 1.42 | 1.37 | 2.8 | A | B | A | A | A | A | C |
| 9 | III | 45 | A | 1.39 | 1.34 | 2.2 | A | C | A | A | A | C | A |
| 10 | IV | 45 | A | 1.42 | 1.34 | 2.4 | A | A | A | A | B | A | C |
| 11 | V | 45 | A | 1.39 | 1.32 | 2.8 | A | C | C | A | B | A | B |
| 12 | VI | 59 | A | 1.45 | 1.42 | 1.7 | B | A | A | A | A | A | A |
| 13 | VI | 62 | A | 1.45 | 1.42 | 1.7 | C | A | A | A | A | A | A |
| Comp. Ex. | | | | | | | | | | | | | |
| 6 | i | 45 | A | 1.22 | 1.18 | 6.0 | A | D | A | C | D | B | D |
| 7 | ii | 45 | A | 1.30 | 1.27 | 5.8 | A | D | B | A | C | B | D |
| 8 | iii | 45 | A | 1.30 | 1.27 | 5.8 | A | B | B | B | D | B | D |
| 9 | iv | 45 | A | 1.35 | 1.30 | 5.0 | A | D | B | A | D | C | D |
| 10 | v | 45 | B | 1.33 | 1.24 | 4.5 | A | B | A | A | D | B | D |
| 11 | v | 70 | B | 1.33 | 1.22 | 4.3 | D | B | A | A | D | B | D |

What is claimed is:

1. A toner for developing electrostatic images, comprising: toner particles said inorganic fine powder being different from said metal oxide particles, inorganic fine powder, resin fine particles, and metal oxide particles; wherein the toner has a weight-average particle size of 4–12 μm and contains at most 30% by number of particles having a particle size of at most 3.17 μm;

the inorganic fine powder has an average primary particle size of 1–50 nm;

the resin fine particles have an average particle size of 0.1–2 μm and a shape factor SF1 of at least 100 and below 150, and the metal oxide particles have an average particle size of 0.3–3 μm and a shape factor SF1 of 150–250.

2. The toner according to claim 1, wherein the resin fine particles have a shape factor SF-1 of at least 115 and below 145, and the metal oxide particles have a shape factor SF-1 of 160–230.

3. The toner according to claim 1, wherein the resin fine particles have a shape factor SF-2 of at least 110 and below 200, and the metal oxide particles have a shape factor SF-2 of 160–300.

4. The toner according to claim 1, wherein the resin fine particles have a shape factor SF-2 of at least 120 and below 175, and the metal oxide particles have a shape factor SF-2 of 175–270.

5. The toner according to claim 1, wherein the inorganic fine powder has a charging polarity identical to that of the toner particles, the resin fine particles have a charging polarity identical to that of the toner particles and a volume resistivity of $10^7$–$10^{14}$ ohm.cm, and the metal oxide particles have a charging polarity opposite to that of the toner particles.

6. The toner according to claim 1, wherein the inorganic fine powder, the resin fine particles and the metal oxide particles are added in amounts of 0.3–3.0 wt. parts, 0.005–0.5 wt. parts and 0.05–5.0 wt. parts, respectively, per 100 wt. parts of the toner particles.

7. The toner according to claim 1, wherein the inorganic fine powder, the resin fine particles and the metal oxide particles have specific surface areas of 70–300 $m^2/g$, 5.0–20.0 $m^2/g$, and 0.5–10.0 $m^2/g$, respectively.

8. The toner according to claim 1, wherein the inorganic fine powder comprises hydrophobic silica.

9. The toner according to claim 1, wherein the inorganic fine powder has been treated with silicone oil.

10. The toner according to claim 1, wherein the resin fine particles comprise a styrene resin or an acrylic resin.

11. The toner according to claim 1, wherein the metal oxide particles comprise strontium titanate.

12. The toner according to claim 1, wherein the metal oxide particles comprise cerium oxide.

13. The toner according to claim 1, wherein the toner particles comprise polymer components characterized by:

(a) containing substantially no THF (tetrahydrofuran)-insoluble content, (b) containing a THF-soluble content giving a GPC (gel-permeation chromatography) chromatogram showing a main peak in a molecular weight region of $3\times10^3$–$3\times10^4$, and a sub-peak or shoulder in a molecular weight region of $1\times10^5$–$3\times10^6$, and (C) having an acid value of at least 1 mgKOH/g.

14. The toner according to claim 13, wherein the polymer components include a low-molecular weight polymer component having molecular weights of below $5\times10^4$ on the GPC chromatogram and an acid value $A_{VL}$, and a high-molecular weight polymer component having molecular weights of at least $5\times10^4$ and an acid value $A_{VH}$ satisfying $A_{VL}>A_{VH}$.

15. The toner according to claim 14, wherein the acid value $A_{VL}$ of the low-molecular weight polymer component is 21–35 mgKOH/, and the acid value $A_{VH}$ of the high-molecular weight polymer component is 0.5–11 mgKOH/g, giving a difference satisfying $10\geqq(A_{VL}-A_{VH}0\geqq27$.

16. The toner according to claim 14, wherein the polymer components provide an acid value/total acid value ratio of at most 0.7.

17. The toner according to claim 13, wherein the THF-soluble content of the polymer components provides the GPC chromatogram showing a minimum value in a molecular weight region of at least $3\times10^4$ and below $1\times10^5$.

18. The toner according to claim 1, wherein the toner particles contain a magnetic material.

19. The toner according to claim 1, wherein the toner particles contain a silicon-containing magnetic material.

20. An apparatus unit, comprising: an electrostatic image-bearing member, and developing means for developing an electrostatic image formed on the electrostatic image-bearing member with a toner contained therein; the electrostatic image-bearing member and the developing means being integrally assembled to form a unit, which is detachably mountable to a main assembly of the image forming apparatus;

wherein the toner comprises toner particles, inorganic fine powder, resin fine particles, and metal oxide particles said inorganic fine powder being different from said metal oxide particles; wherein the toner has a weight-average particle size of 4–12 μm and contains at most 30% by number of particles having a particle size of at most 3.17 μm;

the inorganic fine powder has an average primary particle size of 1–50 nm;

the resin fine particles have an average particle size of 0.1–2 μm and a shape factor SF1 of at least 100 and below 150, and the metal oxide particles have an average particle size of 0.3–3 μm and a shape factor SF1 of 150–250.

21. The apparatus unit according to claim 20, wherein the electrostatic image-bearing member is a photosensitive drum, and the photosensitive drum is provided with a contact-charging means.

22. The apparatus unit according to claim 21, wherein the contact-charging means is a charging roller.

23. The apparatus unit according to claim 21, wherein the electrostatic image-bearing member is provided with a cleaning means.

24. The apparatus unit according to claim 23, wherein the cleaning means is a blade cleaning means.

25. The apparatus unit according to claim 20, wherein the resin fine particles have a shape factor SF-1 of at least 115 and below 145, and the metal oxide particles have a shape factor SF-1 of 160–230.

26. The apparatus unit according to claim 20, wherein the resin fine particles have a shape factor SF-2 of at least 110 and below 200, and the metal oxide particles have a shape factor SF-2 of 160–300.

27. The apparatus unit according to claim 20, wherein the resin fine particles have a shape factor SF-2 of at least 120 and below 175, and the metal oxide particles have a shape factor SF-2 of 175–270.

28. The apparatus unit according to claim 20, wherein the inorganic fine powder has a charging polarity identical to that of the toner particles, the resin fine particles have a charging polarity identical to that of the toner particles and a volume resistivity of $10^7$–$10^{14}$ ohm.cm, and the metal oxide particles have a charging polarity opposite to that of the toner particles.

29. The apparatus unit according to claim 20, wherein the inorganic fine powder, the resin fine particles and the metal oxide particles are added in amounts of 0.3–3.0 wt. parts, 0.005–0.5 wt. parts and 0.05–5.0 wt. parts, respectively, per 100 wt. parts of the toner particles.

30. The apparatus unit according to claim 20, wherein the inorganic fine powder, the resin fine particles and the metal oxide particles have specific surface areas of 70–300 $m^2/g$, 5.0–20.0 $m^2/g$, and 0.5–10.0 $m^2/g$, respectively.

31. The apparatus unit according to claim 20, wherein the inorganic fine powder comprises hydrophobic silica.

32. The apparatus unit according to claim 20, wherein the inorganic fine powder has been treated with silicone oil.

33. The apparatus unit according to claim 20, wherein the resin fine particles comprise a styrene resin or an acrylic resin.

34. The apparatus unit according to claim 20, wherein the metal oxide particles comprise strontium titanate.

35. The apparatus unit according to claim 20, wherein the metal oxide particles comprise cerium oxide.

36. The apparatus unit according to claim 20, wherein the toner particles comprise polymer components characterized by:

(a) containing substantially no THF (tetrahydrofuran)-insoluble content, (b) containing a THF-soluble content giving a GPC (gel-permeation chromatography) chromatogram showing a main peak in a molecular weight region of $3\times10^3$–$3\times10^4$, and a sub-peak or shoulder in a molecular weight region of $1\times10^5$–$3\times10^6$, and (c) having an acid value of at least 1 mgKOH/g.

37. The apparatus unit according to claim 36, wherein the polymer components include a low-molecular weight polymer component having molecular weights of below $5\times10^4$ on the GPC chromatogram and an acid value $A_{VL}$, and a high-molecular weight polymer component having molecular weights of at least $5\times10^4$ and an acid value $A_{VH}$ satisfying $A_{VL}>A_{VH}$.

38. The apparatus unit according to claim 37, wherein the acid value $A_{VL}$ of the low-molecular weight polymer component is 21–35 mgKOH/, and the acid value $A_{VH}$ of the high-molecular weight polymer component is 0.5–11 mgKOH/g, giving a difference satisfying $10\geqq(A_{VL}-A_{VH}0\geqq27$.

39. The apparatus unit according to claim 36, wherein the polymer components provide an acid value/total acid value ratio of at most 0.7.

40. The apparatus unit according to claim 36, wherein the THF-soluble content of the polymer components provides the GPC chromatogram showing a minimum value in a molecular weight region of at least $3\times10^4$ and below $1\times10^5$.

41. The apparatus unit according to claim 20, wherein the toner particles contain a magnetic material.

42. The apparatus unit according to claim 20, wherein the toner particles contain a silicon-containing magnetic material.

43. An image forming method, comprising the steps of:

charging a surface of an electrostatic image-bearing member, forming an electrostatic image on the electrostatic image-bearing member;

developing the electrostatic image with a toner for developing electrostatic images to form a toner image;

transferring the toner image formed on the electrostatic image-bearing member to a transfer-receiving material, cleaning the surface of the electrostatic image-bearing member after the transfer by abutting a cleaning member thereto, and repeating the above-mentioned steps by using the cleaned electrostatic image-bearing member;

wherein the toner comprises toner particles, inorganic fine powder, resin fine particles, and metal oxide particles said inorganic fine powder being different from said metal oxide particles; wherein the toner has a weight-average particle size of 4–12 μm and contains at most 30% by number of particles having a particle size of at most 3.17 μm;

the inorganic fine powder has an average primary particle size of 1–50 nm;

the resin fine particles have an average particle size of 0.1–2 μm and a shape factor SF1 of at least 100 and below 150, and the metal oxide particles have an average particle size of 0.3–3 μm and a shape factor SF1 of 150–250.

44. The method according to claim 43, wherein the electrostatic image-bearing member is charged with a contact-charging means supplied with a bias voltage.

45. The method according to claim 44, wherein the electrostatic image-bearing member is a photosensitive drum, and the contact-charging means is a charging roller.

46. The method according to claim 43, wherein the resin fine particles have a shape factor SF-1 of at least 115 and below 145, and the metal oxide particles have a shape factor SF-1 of 160–230.

47. The method according to claim 43, wherein the resin fine particles have a shape factor SF-2 of at least 110 and below 200, and the metal oxide particles have a shape factor SF-2 of 160–300.

48. The method according to claim 43, wherein the resin fine particles have a shape factor SF-2 of at least 120 and below 175, and the metal oxide particles have a shape factor SF-2 of 175–270.

49. The method according to claim 43, wherein the inorganic fine powder has a charging polarity identical to that of the toner particles, the resin fine particles have a charging polarity identical to that of the toner particles and a volume resistivity of $10^7$–$10^{14}$ ohm.cm, and the metal oxide particles have a charging polarity opposite to that of the toner particles.

50. The method according to claim 43, wherein the inorganic fine powder, the resin fine particles and the metal oxide particles are added in amounts of 0.3– 3.0 wt. parts, 0.005–0.5 wt. parts and 0.05–5.0 wt. parts, respectively, per 100 wt. parts of the toner particles.

51. The method according to claim 43, wherein the inorganic fine powder, the resin fine particles and the metal oxide particles have specific surface areas of 70–300 $m^2/g$, 5.0–20.0 $m^2/g$, and 0.5–10.0 $m^2/g$, respectively.

52. The method according to claim 43, wherein the inorganic fine powder comprises hydrophobic silica.

53. The method according to claim 43, wherein the inorganic fine powder has been treated with silicone oil.

54. The method according to claim 43, wherein the resin fine particles comprise a styrene resin or an acrylic resin.

55. The method according to claim 43, wherein the metal oxide particles comprise strontium titanate.

56. The method according to claim 43, wherein the metal oxide particles comprise cerium oxide.

57. The method according to claim 43, wherein the toner particles comprise polymer components characterized by:

(a) containing substantially no THF (tetrahydrofuran)-insoluble content, (b) containing a THF-soluble content giving a GPC (gel-permeation chromatography) chromatogram showing a main peak in a molecular weight region of $3\times10^3$–$3\times10^4$, and a sub-peak or shoulder in a molecular weight region of $1\times10^5$–$3\times10^6$, and (c) having an acid value of at least 1 mgKOH/g.

58. The method according to claim 57, wherein the polymer components include a low-molecular weight polymer component having molecular weights of below $5\times10^4$ on the GPC chromatogram and an acid value $A_{VL}$, and a high-molecular weight polymer component having molecular weights of at least $5\times10^4$ and an acid value $A_{VH}$ satisfying $A_{VL}>A_{VH}$.

59. The method according to claim 58, wherein the acid value $A_{VL}$ of the low-molecular weight polymer component is 21–35 mgKOH/, and the acid value $A_{VH}$ of the high-molecular weight polymer component is 0.5–11 mgKOH/g, giving a difference satisfying $10\geqq(A_{VL}-A_{VH}0\geqq27$.

60. The method according to claim 57, wherein the polymer components provide an acid value/total acid value ratio of at most 0.7.

61. The method according to claim 57, wherein the THF-soluble content of the polymer components provides the GPC chromatogram showing a minimum value in a molecular weight region of at least $3\times10^4$ and below $1\times10^5$.

62. The method according to claim 43, wherein the toner particles contain a magnetic material.

63. The method according to claim 43, wherein the toner particles contain a silicon-containing magnetic material.

64. A toner for developing electrostatic images, comprising: toner particles said inorganic fine powder being different from said metal oxide particles, inorganic fine powder, resin fine particles, and metal oxide particles; wherein the inorganic fine powder has a charging polarity identical to that of the toner particles and a specific surface area of 70–300 $m^2/g$, the resin fine particles have a charging polarity identical to that of the toner particles, a specific surface area of 5.0–20.0 $m^2/g$ and a volume resistivity of $10^7$–$10^{14}$ ohm.cm, and the metal oxide particles have a charging polarity opposite to that of the toner particles and a specific surface area of 0.5–10.0 $m^2/g$.

65. An image forming method, comprising the steps of charging a surface of an electrostatic image-bearing member, forming an electrostatic image on the electrostatic image-bearing member, developing the electrostatic image with a toner for developing electrostatic images to form a toner image, transferring the toner image formed on the electrostatic image-bearing member to a transfer-receiving material, cleaning the surface of the electrostatic image-bearing member after the transfer by abutting a cleaning member thereto, and repeating the above-mentioned steps by using the cleaned electrostatic image-bearing member; wherein the toner comprises toner particles, inorganic fine powder, resin fine particles, and metal oxide particles said inorganic fine powder being different from said metal oxide particles;

the inorganic fine powder has a charging polarity identical to that of the toner particles and a specific surface area of 70–300 $m^2/g$, the resin fine particles have a charging polarity identical to that of the toner particles, a specific surface area of 5.0–20.0 $m^2/g$ and a volume resistivity of $10^7 10^{14}$ ohm.cm, and the metal oxide particles have a charging polarity opposite to that of the toner particles and a specific surface area of 0.5–10.0 $m^2/g$.

* * * * *

UNITED STATES PATENT AND TRADEMARK OFFICE

CERTIFICATE OF CORRECTION

PATENT NO. : 5,712,073

DATED : January 27, 1998

INVENTOR(S) : MASAICHIRO KATADA, ET AL.

It is certified that error appears in the above-identified patent and that said Letters Patent is hereby corrected as shown below:

On the title page,
AT [75] INVENTORS:

"Shizuoka-ken" should read --Nagaizumicho--.

COLUMN 6

Line 8, "for" should read --that--.

COLUMN 8

Line 7, "alkyl" should read --an alkyl--; and
Line 47, "se." should be deleted
Line 48, "paration" should read -- separation --

COLUMN 9

Line 22, "such a" should read --such as--; and
Line 23, "acrylic acid," (first occurrence) should be deleted.

COLUMN 15

Line 37, "than" should read --over--.

COLUMN 19

Line 36, "the," should read --the--; and
Line 62, "based" should read --based on--.

COLUMN 21

Line 21, "above-purpose" should read --above purpose--; and
Line 38, "monomethyl-siloxane" should read --monomethylsiloxane--.

UNITED STATES PATENT AND TRADEMARK OFFICE

CERTIFICATE OF CORRECTION

PATENT NO. : 5,712,073

DATED : January 27, 1998

INVENTOR(S) : MASAICHIRO KATADA, ET AL.

It is certified that error appears in the above-identified patent and that said Letters Patent is hereby corrected as shown below:

COLUMN 22

Line 25, "as show" should read --as shown--.

COLUMN 23

Example 1, "0.8" should read --=0.8--.

COLUMN 24

Line 12, "a shape" should read --shaped--; and
Line 13, "EXAMPLE" should read --EXAMPLES--.

COLUMN 28

Line 2, "drum" should read --drum B--.

COLUMN 29

Line 51, "said inorganic fine powder being differ-" should be deleted;
Line 52, "ent from said metal oxide particles" should be deleted; and
Line 53, "particles" (second occurrence) should read --particles, said inorganic fine powder being different from said metal oxide particles--.

COLUMN 31

Line 23, "(C)" should read --(c)--; and
Line 35, "$\geqq$" (both occurrences) should read --$\leqq$-- and "$-A_{VH}O$" should read -- $-A_{VH}O$)--.

UNITED STATES PATENT AND TRADEMARK OFFICE

CERTIFICATE OF CORRECTION

PATENT NO. : 5,712,073

DATED : January 27, 1998

INVENTOR(S) : MASAICHIRO KATADA, ET AL.

It is certified that error appears in the above-identified patent and that said Letters Patent is hereby corrected as shown below:

COLUMN 33

Line 8, "$\geqq$" should read --$\leqq$--; and
Line 9, "$-A_{VH}O\geqq$" should read -- $-A_{VH}O)\leqq$--.

COLUMN 34

Line 49, "$\geqq$" (both occurrences) should read --$\leqq$-- and "$-A_{VH}O$" should read -- $-A_{VH}O)$--;
Line 62, "said inorganic fine powder being differ-" should be deleted;
Line 63, "ent from said metal oxide particles" should be deleted; and
Line 64, "particles" (second occurrence) should read --particles, said inorganic fine powder being different from said metal oxide particles--.

Signed and Sealed this

Thirteenth Day of October 1998

*Attest:*

*Attesting Officer*

BRUCE LEHMAN

*Commissioner of Patents and Trademarks*